US010020591B2

(12) United States Patent
Uemichi

(10) Patent No.: US 10,020,591 B2
(45) Date of Patent: Jul. 10, 2018

(54) SLOTTED WAVEGUIDE ARRAY ANTENNA AND SLOTTED ARRAY ANTENNA MODULE

(71) Applicant: FUJIKURA LTD., Tokyo (JP)

(72) Inventor: Yusuke Uemichi, Sakura (JP)

(73) Assignee: FUJIKURA LTD., Tokyo (JP)

( * ) Notice: Subject to any disclaimer, the term of this patent is extended or adjusted under 35 U.S.C. 154(b) by 80 days.

(21) Appl. No.: 14/889,536

(22) PCT Filed: Feb. 25, 2015

(86) PCT No.: PCT/JP2015/055444
§ 371 (c)(1),
(2) Date: Nov. 6, 2015

(87) PCT Pub. No.: WO2015/162992
PCT Pub. Date: Oct. 29, 2015

(65) Prior Publication Data
US 2016/0126637 A1 May 5, 2016

(30) Foreign Application Priority Data
Apr. 23, 2014 (JP) ..... 2014-089107

(51) Int. Cl.
*H01Q 13/22* (2006.01)
*H01Q 21/00* (2006.01)

(52) U.S. Cl.
CPC ..... *H01Q 13/22* (2013.01); *H01Q 21/0043* (2013.01)

(58) Field of Classification Search
CPC ..... H01Q 13/10; H01Q 13/18; H01Q 13/20; H01Q 13/22; H01Q 21/0037; H01Q 21/0043; H01Q 21/005; H01Q 21/0062
See application file for complete search history.

(56) References Cited

U.S. PATENT DOCUMENTS 5,010,351 A * 4/1991 Kelly ..... H01Q 21/064 343/771
5,541,612 A 7/1996 Josefsson
(Continued)

FOREIGN PATENT DOCUMENTS

CN 1656648 A 8/2005
CN 103165966 A 6/2013
(Continued)

OTHER PUBLICATIONS

Office Action dated Feb. 21, 2017, issued in counterpart Chinese Application No. 201580000753.5. (8 pages).
(Continued)

*Primary Examiner* — Tho G Phan
*Assistant Examiner* — Patrick Holecek
(74) *Attorney, Agent, or Firm* — Westerman, Hattori, Daniels & Adrian, LLP

(57) ABSTRACT

A slotted waveguide array antenna having a smaller reflection coefficient and a larger gain than conventional one is realized. In a slotted waveguide array antenna (1A), control walls (12*c*1-12*c*6) orthogonal to an upper wall (11) and side walls of the waveguide are provided inside the waveguide, and slots (11*d*1-11*d*6) each extend over an interface between regions formed by partition with corresponding one of the control walls but do not overlap the corresponding one of the plurality of control walls when viewed from above.

12 Claims, 11 Drawing Sheets

(56) References Cited

U.S. PATENT DOCUMENTS

| | | | | |
|---|---|---|---|---|
| 6,201,507 | B1 | 3/2001 | Park et al. | |
| 7,808,439 | B2 * | 10/2010 | Yang | H01P 3/121 343/770 |
| 2006/0164315 | A1 | 7/2006 | Munk | |
| 2013/0154759 | A1 * | 6/2013 | Morita | H01P 3/081 333/26 |

FOREIGN PATENT DOCUMENTS

| | | | |
|---|---|---|---|
| JP | 10-190349 | A | 7/1998 |
| JP | 10-303611 | A | 11/1998 |
| JP | 11-284409 | A | 10/1999 |
| JP | 2003-289201 | A | 10/2003 |
| JP | 2003-318648 | A | 11/2003 |
| JP | 2005-167755 | A | 6/2005 |
| JP | 3923360 | B2 | 5/2007 |
| JP | 2012-175624 | A | 9/2012 |
| JP | 2013-126099 | A | 6/2013 |

OTHER PUBLICATIONS

International Search Report dated May 19, 2015, issued in counterpart application No. PCT/JP2015/055444 (2 pages).
Japanese Office Action dated Aug. 26, 2014, issued in counterpart application No. JP2014-089107 (2 pages).
Japanese Office Action dated Mar. 24, 2015, issued in counterpart application No. JP2014-089107 (1 page).
Office Action dated Sep. 25, 2017, issued in counterpart Chinese Application No. 201580000753.5, with English translation. (17 pages).
Office Action dated Apr. 3, 2018, issued in counterpart Chinese Application No. 201580000753.5, with English translation. (14 pages).

* cited by examiner

SLOTTED WAVEGUIDE ARRAY ANTENNA AND SLOTTED ARRAY ANTENNA MODULE

TECHNICAL FIELD

The present invention relates to a slotted waveguide array antenna and a slotted array antenna module including the slotted waveguide array antenna.

BACKGROUND ART

WiGig® has been attracting attention as a next-generation wireless LAN standard. With use of millimeter waves of 60 GHz band, WiGig realizes ultrafast wireless transmission at up to 6.75 GB/sec. Accordingly, antennas for 60 GHz band are likely to be mounted on commercial devices, such as PCs and smart phones, with a large market size, and are expected to have an increasing demand.

A known example of an antenna whose operation band is a millimeter wave band is a slotted waveguide tube array antenna made of a metallic waveguide tube having a plurality of slots in one surface of the waveguide tube. For such a slotted waveguide tube array antenna, it is important to reduce reflection occurring at each slot, because reflection occurring at each slot deteriorates reflection characteristics and causes gain reduction.

A known example of a slotted waveguide tube array antenna in which reflection occurring at each slot is reduced is a slotted waveguide tube array antenna disclosed in Patent Literature 1. The slotted waveguide tube array antenna disclosed in Patent Literature 1 is arranged such that a wall plate is provided inside the metallic waveguide tube having slots so that a wave reflected at each slot is canceled out by a wave reflected at the wall plate.

CITATION LIST

Patent Literature

[Patent Literature 1]
Japanese Patent Application Publication Tokukai No. 2005-167755 (published on Jun. 23, 2005)

SUMMARY OF INVENTION

Technical Problem

However, in terms of reduction of a reflection coefficient in an operation band and increase of a gain, the slotted waveguide tube array antenna disclosed in Patent Literature 1 still had a room for improvement in layout of the slots and the wall plate.

Furthermore, the slotted waveguide tube array antenna disclosed in Patent Literature 1 has side problems as below. Specifically, the slotted waveguide tube array antenna disclosed in Patent Literature 1 is constituted by (i) a base having a rectangular waveguide tube and a wall plate and (ii) a slot plate provided with a plurality of slots. The slotted waveguide tube array antenna is produced by bonding the base and the slot plate each of which has been individually prepared by metal processing etc. This has caused a problem that a production cost is high. Furthermore, it has been difficult to cause the base and the slot plate to tightly adhere to each other, resulting in a problem that a transmission quality is likely to deteriorate.

The present invention is attained in view of the foregoing problems. An object of the present invention is to provide a slotted waveguide array antenna capable of reducing a reflection coefficient in a desired frequency range and selectively increasing a gain in a desired frequency range, as compared to conventional slotted waveguide array antennas.

Solution to Problem

In order to solve the foregoing problems, a slotted waveguide array antenna of the present invention is a slotted waveguide array antenna, including: a waveguide having a rectangular parallelepiped shape, the waveguide having a plurality of slots in an upper wall of the waveguide; and a plurality of control walls inside the waveguide, the plurality of control walls being perpendicular to the upper wall and side walls of the waveguide, each of the plurality of slots bridging an interface between regions resulting from partitioning by corresponding one of the plurality of control walls, and said each of the plurality of slots not overlapping the corresponding one of the plurality of control walls when seen from above.

Advantageous Effects of Invention

The present invention makes it possible to provide a slotted waveguide array antenna capable of reducing a reflection coefficient in a desired frequency range and selectively increasing a gain in a desired frequency range, as compared to conventional slotted waveguide array antennas.

Figure 5:
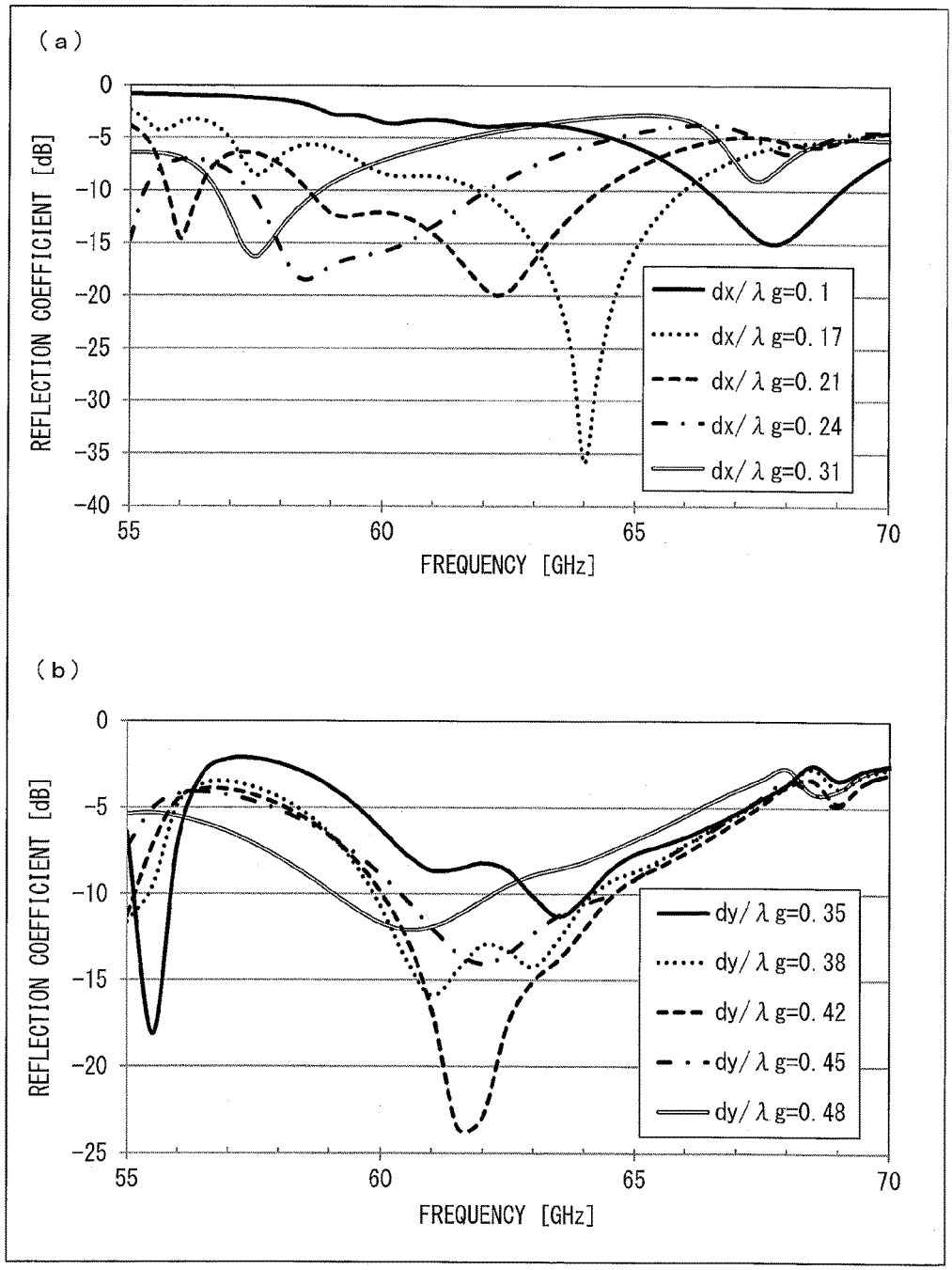

(a) of FIG. 5 is a graph showing reflection characteristics of the slotted waveguide array antennas in Example 1 in a case where a distance $dx/\lambda_g$ was varied in a range of 0.1 to 0.31. (b) of FIG. 5 is a graph showing reflection characteristics of the slotted waveguide array antennas in a case where the distance $dy/\lambda_g$ was varied in a range of 0.35 to 0.48.

Figure 6:
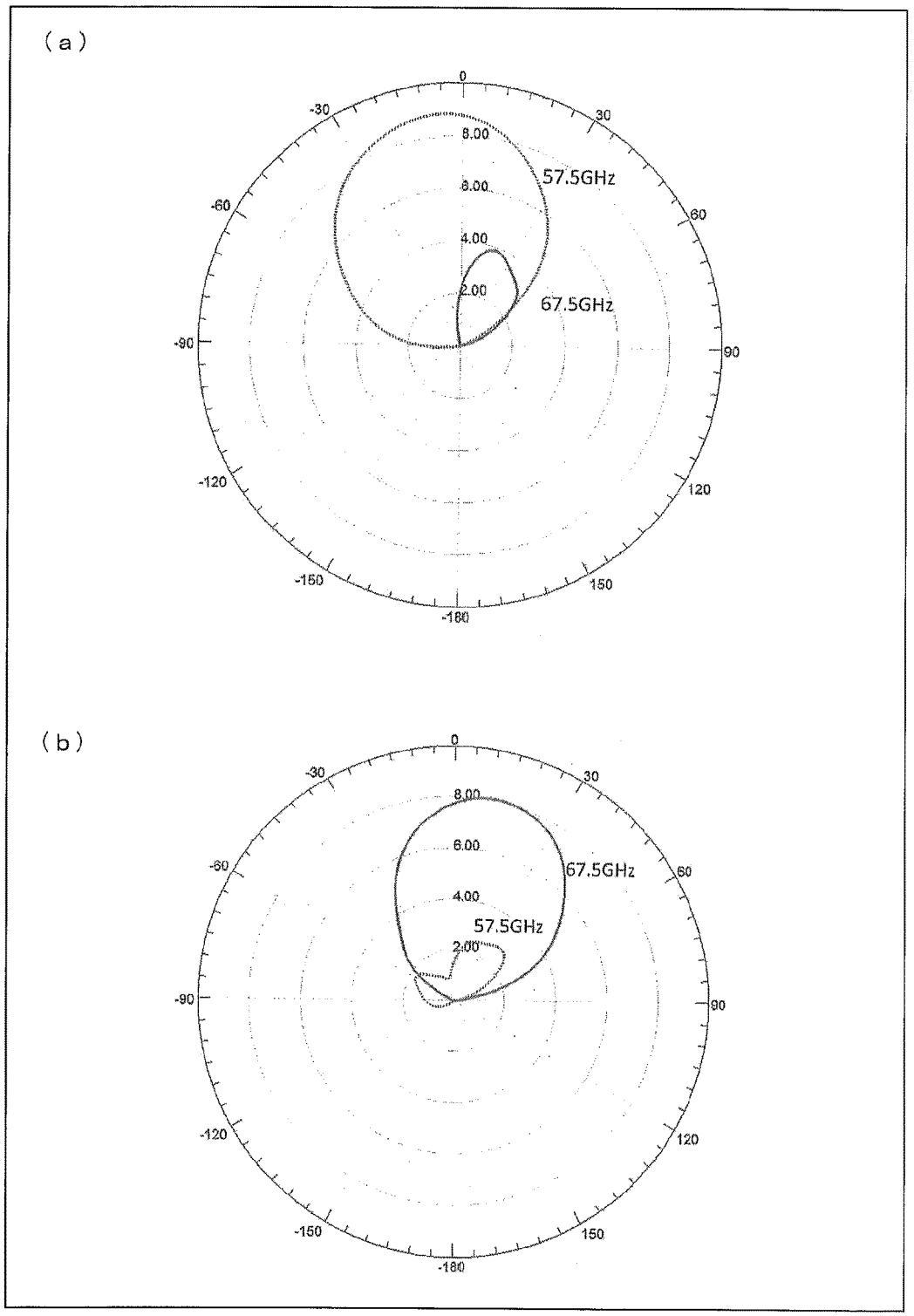

(a) of FIG. 6 is a graph showing an azimuth-dependency of gain in a z-x plane of the slotted waveguide array antenna whose distance $dx/\lambda_g$ was 0.31 among the slotted waveguide array antennas in Example 1. (b) of FIG. 6 is a graph showing an azimuth-dependency of a gain in a z-x plane of the slotted waveguide array antenna whose distance $dx/\lambda_g$ was 0.1 among the slotted waveguide array antennas in Example 1.

Figure 7:
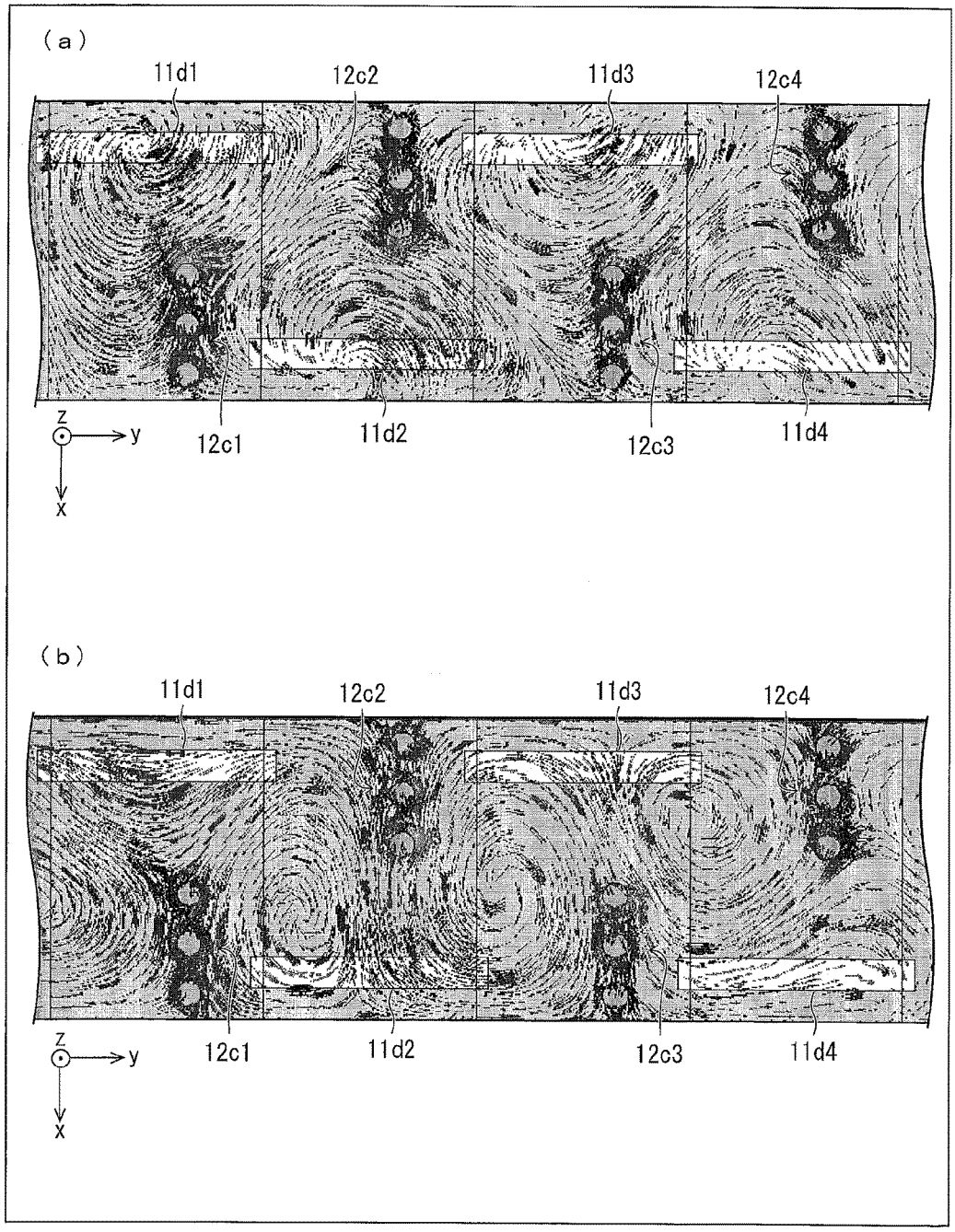

(a) of FIG. 7 is a graph showing a magnetic field distribution in a case where an electromagnetic wave of 57.5 GHz was fed to the slotted waveguide array antenna whose distance $dx/\lambda_g$ was 0.31 among the slotted array antennas in Example 1. (b) of FIG. 7 is a graph showing a magnetic field distribution in a case where an electromagnetic wave of 67.5 GHz was fed to that slotted waveguide array antenna.

Figure 8:
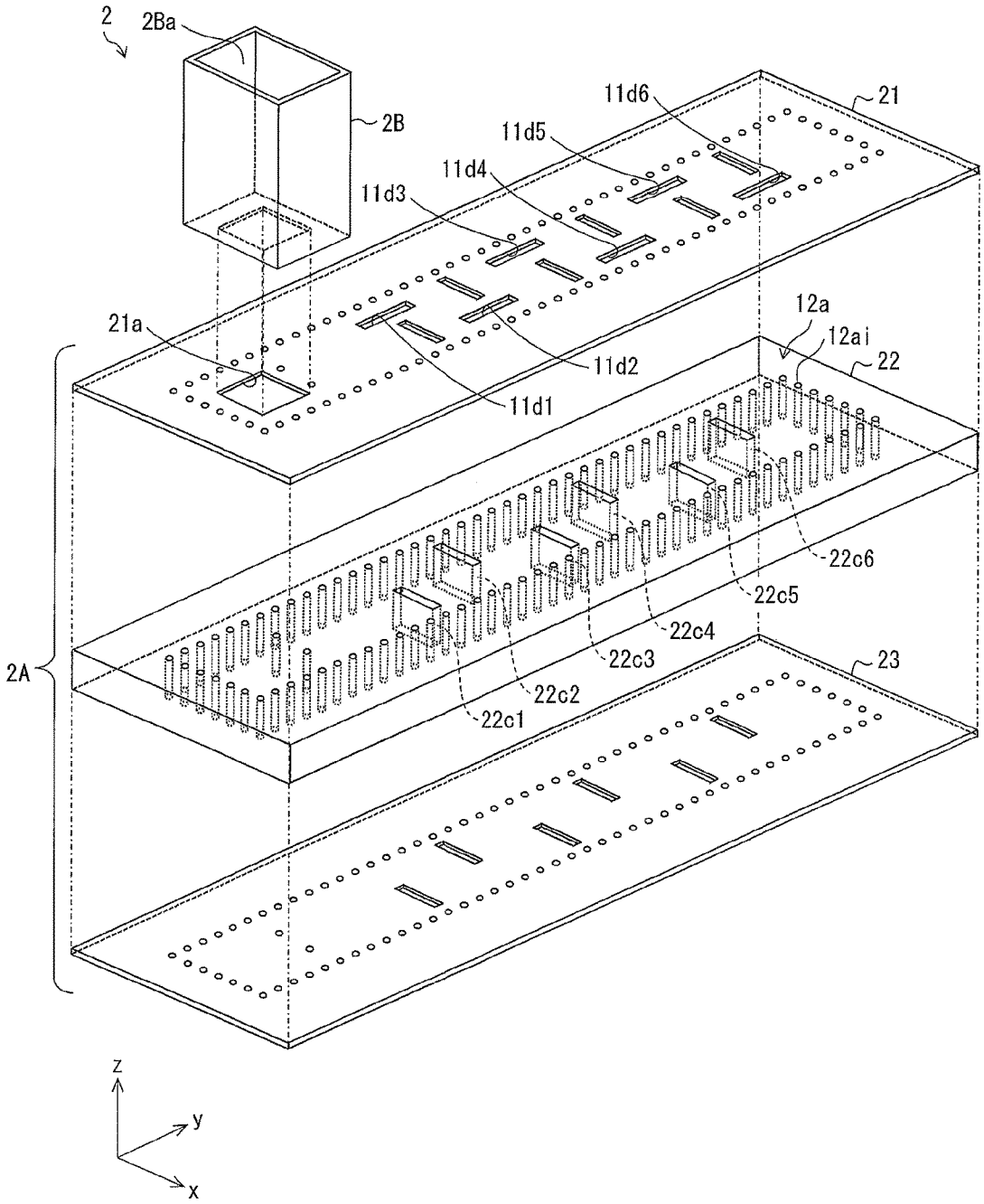

FIG. 8 is an exploded perspective view of a slotted array antenna module including a slotted waveguide array antenna in accordance with First Modified Example.

Figure 9:
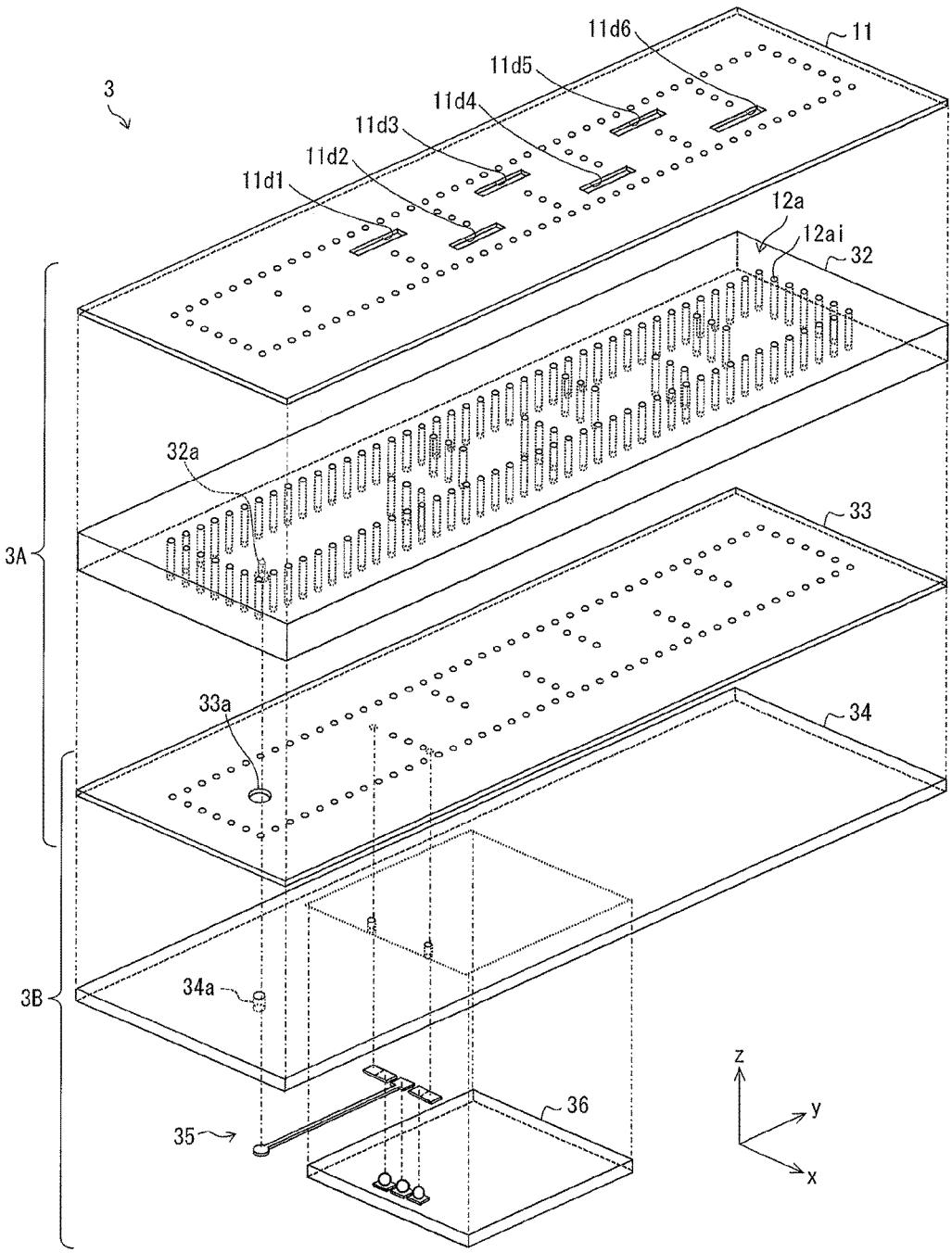

FIG. 9 is an exploded perspective view of a slotted array antenna module including a slotted waveguide array antenna in accordance with Second Embodiment of the present invention.

Figure 10:
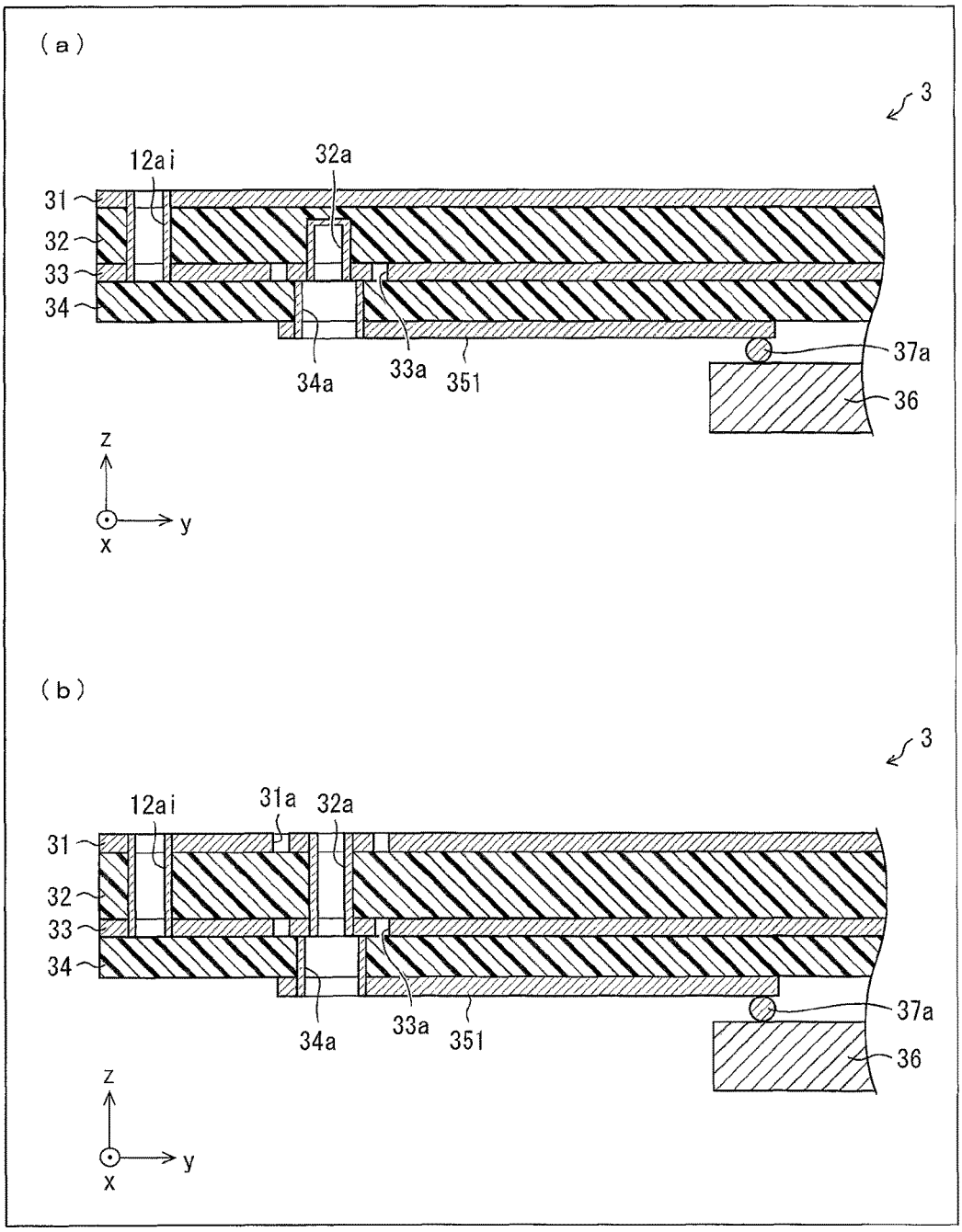

(a) of FIG. 10 is a cross sectional view of the slotted array antenna module illustrated in FIG. 9, and illustrates structures of a feeding pin and a post. (b) of FIG. 10 is a cross sectional view of another aspect of the slotted array antenna module in which a structure of a feeding pin in the slotted array antenna module is changed.

Figure 11:
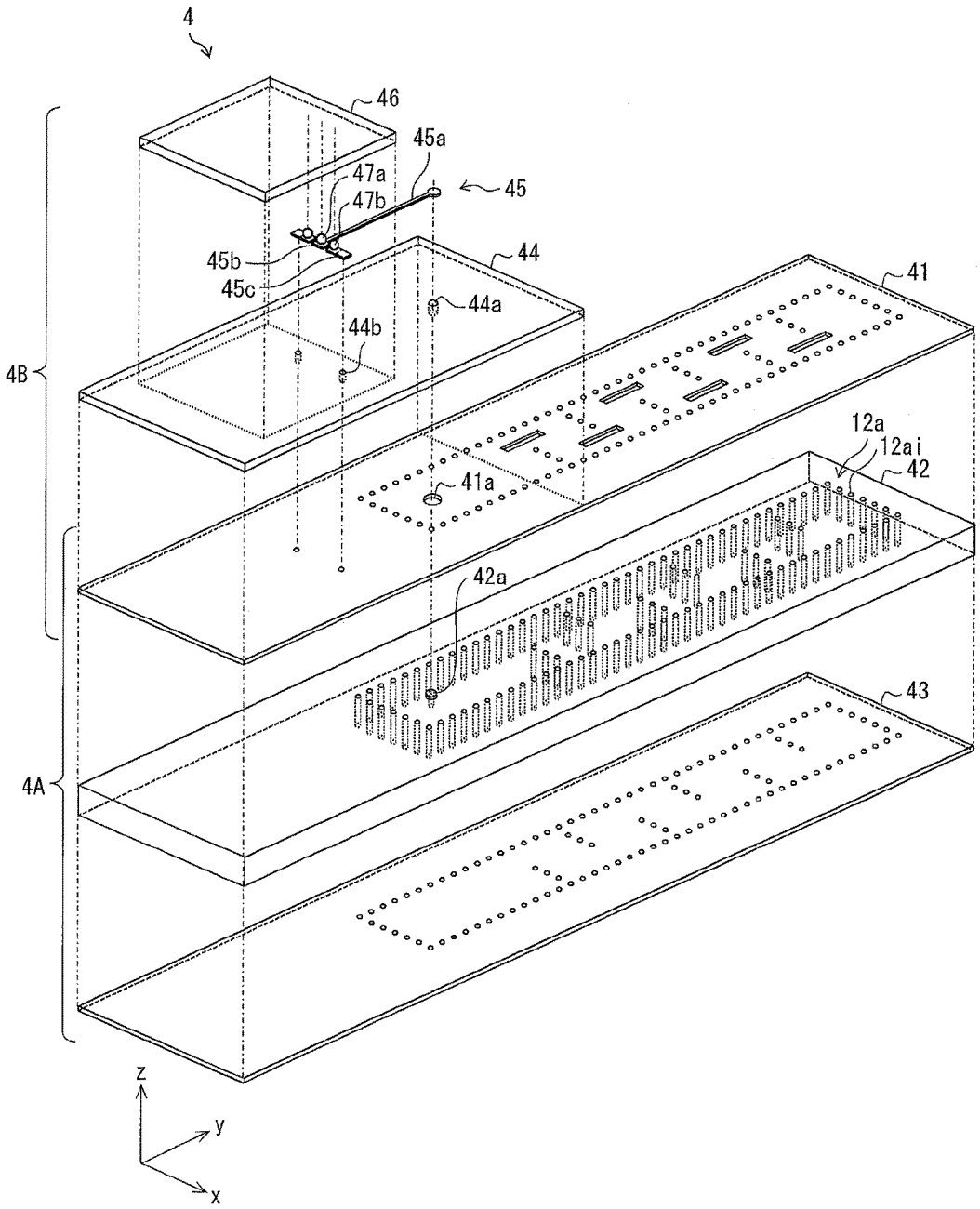

FIG. 11 is an exploded perspective view of a slotted array antenna module including a slotted waveguide array antenna in accordance with Second Modified Example.

DESCRIPTION OF EMBODIMENTS

First Embodiment

[Arrangement of Slotted Array Antenna Module]

Figure 1:
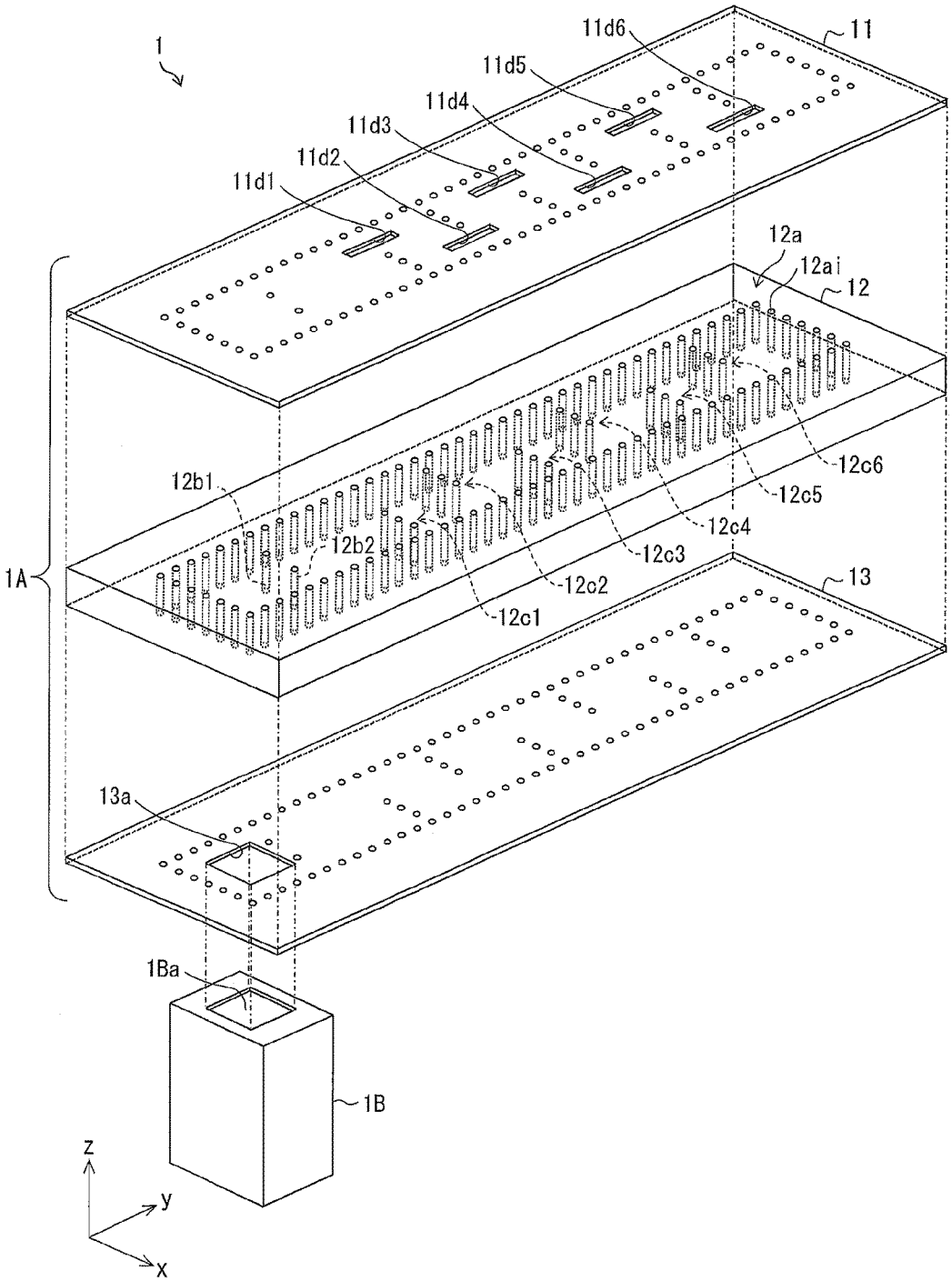
FIG. 1 is an exploded perspective view of a slotted array antenna module including a slotted waveguide array antenna in accordance with First Embodiment of the present invention.
Figure 2:
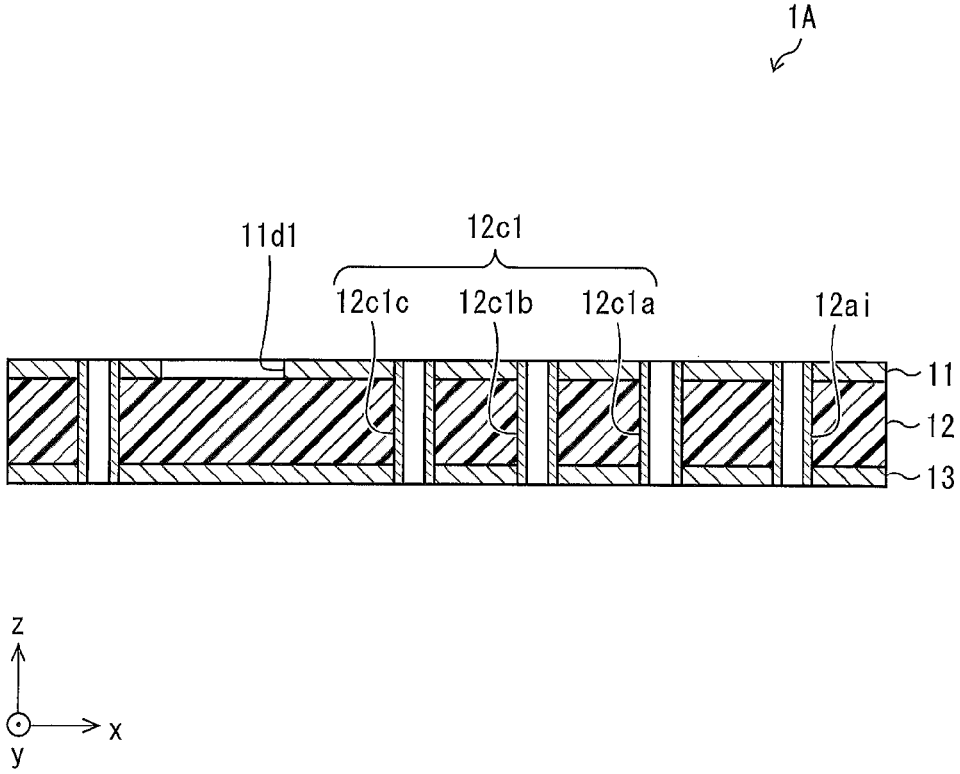
FIG. 2 is a cross sectional view of the slotted waveguide array antenna illustrated in FIG. 1.

With reference to FIGS. 1 and 2, the following discusses a slotted waveguide array antenna in accordance with First Embodiment of the present invention. FIG. 1 is an exploded perspective view of a slotted array antenna module 1 including a slotted waveguide array antenna 1A in accordance with First Embodiment. FIG. 2 is a cross sectional view of the slotted waveguide array antenna in accordance with First Embodiment.

As illustrated in FIG. 1, the slotted array antenna module 1 includes a slotted waveguide array antenna 1A and a waveguide tube 1B. The slotted waveguide array antenna 1A has a structure in which a first conductor layer 11, a first dielectric layer 12, and a second conductor layer 13 are laminated in this order. In other words, the slotted waveguide array antenna 1A is constituted by the first conductor layer 11 and the second conductor layer 13 which face each other via the first dielectric layer 12.

In First Embodiment, the first conductor layer 11, the first dielectric layer 12, and the second conductor layer 13 have their respective main surfaces parallel to an x-y plane in a coordinate system in FIG. 1. The main surfaces herein mean surfaces having the largest area among six surfaces constituting a member having a rectangular parallelepiped shape.

Materials for the first conductor layer 11 and the second conductor layer 13 can be metals such as copper. A material for the first dielectric layer 12 can be any of glasses such as silica glass, fluorine-based resins such as PTFE, liquid crystal polymers, cycloolefin polymers, and the like.

The first conductor layer 11 has slots 11*d*1 through 11*d*6. The slots 11*d*1 through 11*d*6 are rectangular openings formed in the first conductor layer 11. The slots 11*d*1 through 11*d*6 are provided in a zigzag manner when the slotted waveguide array antenna 1A is viewed from above. Herein, being viewed from above means being viewed from a positive z-axis in the coordinate system in FIG. 1. A layout of the slots 11*d*1 through 11*d*6 will be described more specifically with reference to other drawings.

The first dielectric layer 12 includes therein a post wall 12*a* surrounding four sides of a rectangular parallelepiped region serving as a waveguide. The post wall 12*a* is a set of a plurality of conductor posts 12*a*1, 12*a*2, . . . 12*a*M which are laid out in the form of a fence. Each conductor post 12*ai* (i=1, 2, . . . , M) is a cylindrical conductor whose upper end is connected to the first conductor layer 11 and whose lower end is connected to the second dielectric layer 13. More specifically, each conductor post 12*ai* is a conductor plating formed on a wall surface of a through hole formed through the first dielectric layer 12. The region whose four sides are surrounded by the post wall 12*a* is provided in such a manner that a long-side direction of the region is parallel to a y-axis of the coordinate system in FIG. 1.

The region whose four sides are surrounded by the post wall 12*a* and which is sandwiched by the first conductor layer 11 and the second conductor layer 13 at top and bottom sides, respectively, serves as a waveguide of the slotted waveguide array antenna 1A. The post wall 12*a* serves as side walls of the waveguide, the first waveguide layer 11 serves as a top wall of the waveguide, and the second conductor layer 13 serves as a bottom wall of the waveguide. In the following description, among the side walls of the waveguide, a side wall on a positive side in an x-axis direction is referred to as a right side wall, a side wall on a negative side in the x-axis direction is referred to as a left side wall, a side wall on a positive side in a y-axis direction is referred to as a front side wall, and a side wall on a negative side in the y-axis direction is referred to as a rear side wall. The front side wall and the rear side wall each may also be referred to as a short wall.

The waveguide of the slotted waveguide array antenna 1*a* includes therein control walls 12*c*1 through 12*c*6 which are orthogonal to each of the upper wall, the left side wall, and the right side wall of the waveguide (i.e. parallel to z-x plane in FIG. 1). The control walls 12*c*1, 12*c*3, and 12*c*5 which are odd-numbered control walls in count from those closer to an opening 13*a* are extended leftward (in a negative direction of an x-axis in FIG. 1) from the vicinity of the right side wall. On the other hand, the control walls 12*c*2, 12*c*4, and 12*c*6 which are even-numbered control walls in count from those closer to the opening 13*a* are extended rightward (in a positive direction of the x-axis in FIG. 1) from the vicinity of the left side wall. Accordingly, the control walls 12*c*1 through 12*c*6 appear to be provided in a zigzag manner.

The coordinate system in FIG. 1 is defined as follows. (1) A y-axis is set to correspond to a long side direction of the waveguide of the first dielectric layer 12. As to a definition of a direction of the y-axis, a direction from a feeding section of the waveguide toward a front end of the waveguide is defined as a positive direction of the y-axis. (2) A z-axis is defined as an axis parallel to a thickness direction of the first dielectric layer 12. As to a definition of a direction of the z-axis, a direction from the second conductor layer 13 toward the first conductor layer 11 is defined as a positive direction of the z-axis. (3) The x-axis is defined as an axis parallel to a width direction of the waveguide of the first dielectric layer 12. A direction of the x-axis is defined such that the x-axis constitutes a right-handed system together with the y-axis and the z-axis mentioned above.

The following discusses an arrangement of the control wall, taking the control wall 12*c*1 as an example. FIG. 2 is a cross sectional view of the slotted waveguide array antenna 1A taken along a z-x plane across the control wall 12*c*1. As illustrated in FIG. 2, the control wall 12*c*1 is a set of three conductor posts 12*c*1*a*, 12*c*1*b*, and 12*c*1*c*. Each of the conductor posts 12*c*1*a* through 12*c*1*c* is a cylindrical conductor whose upper end is connected to the first conductor layer 11 and whose lower end is connected to the second dielectric layer 13. More specifically, each of the conductor posts 12*c*1*a* through 12*c*1*c* is a conductor plating formed on a wall surface of a through hole formed through the first dielectric layer 12.

The conductor posts 12*c*1*a*, 12*c*1*b*, and 12*c*1*c* are provided at intervals which are sufficiently shorter than a wavelength of an electromagnetic wave propagating through the waveguide of the slotted waveguide array antenna 1A. Furthermore, a distance between the conductor post 12*c*1*a* constituting the control wall and the conductor post 12*ai* constituting the side wall is also set to be sufficiently shorter than the wavelength of the electromagnetic wave propagating through the waveguide of the slotted waveguide array antenna 1A. Consequently, the control wall 12*c*1 which is the set of the conductor posts 12*c*1*a*, 12*c*1*b*, and 12*c*1*c* serves as a post wall for reflecting the electromagnetic wave.

As described above, the control wall 12*c*1 is a post wall which extends in the negative direction of the x-axis from the right side wall of the waveguide of the slotted waveguide array antenna 1A and which is parallel to the z-x plane. The control walls 12*c*3 and 12*c*5 which are odd-numbered control walls other than the control wall 12*c*1 are arranged similarly to the control wall 12*c*1. The control walls 12*c*2, 12*c*4, and 12*c*6 which are even-numbered control walls are post walls which extend in the positive direction of the x-axis from the left side wall of the waveguide of the slotted waveguide array antenna 1A and which are parallel to the z-x plane. A width of each of the control walls 12*c*2, 12*c*4, and 12*c*6 is equal to a width of the control wall 12*c*1.

Figure 3:
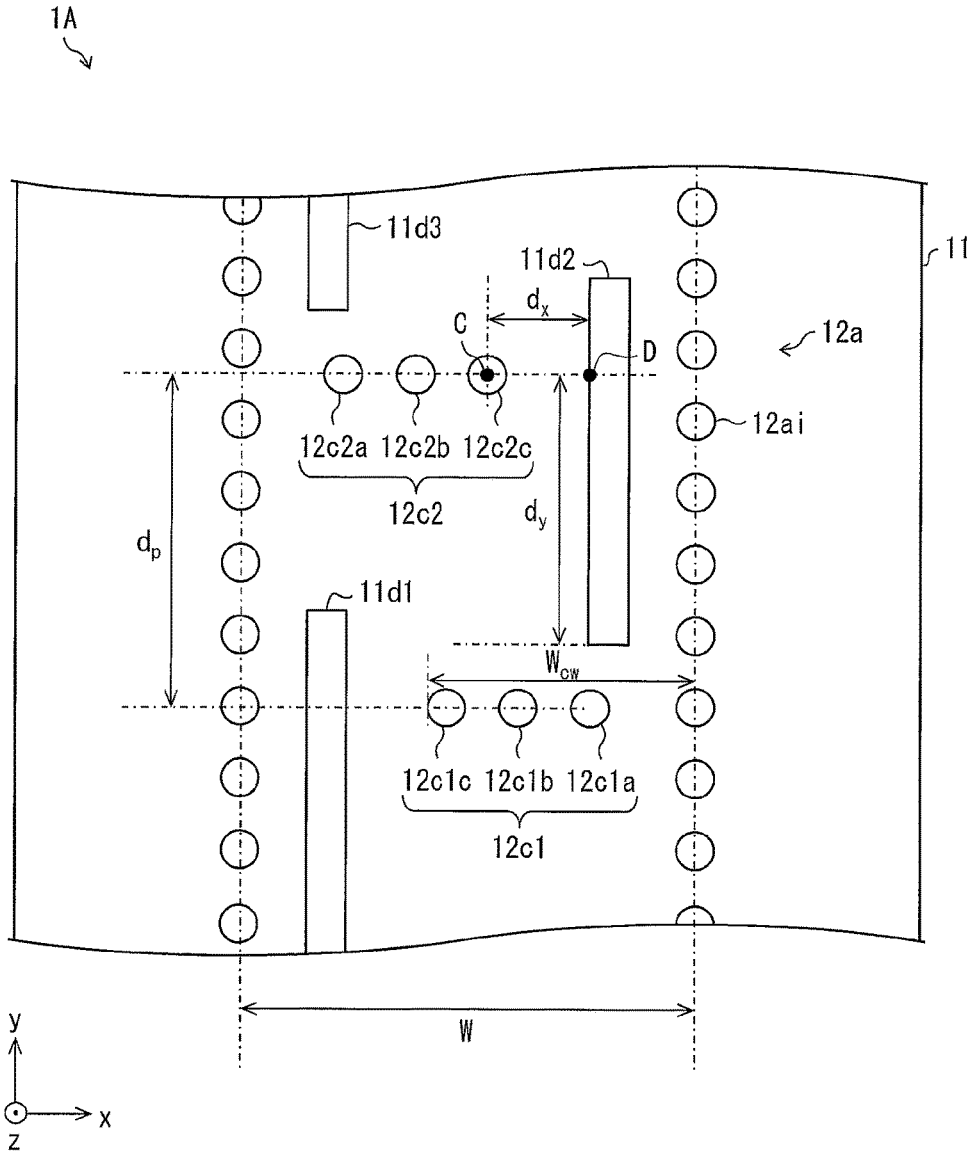
FIG. 3 is a plan view of a part of the slotted waveguide array antenna illustrated in FIG. 1 when viewed from above.

In First Embodiment, a width W of the waveguide of the slotted waveguide array antenna 1A is defined as a distance between (a) a center line of the left side wall of the waveguide and (b) a center line of the right side wall of the waveguide (see FIG. 3). Furthermore, a width $W_{cw}$ of the control wall is defined, with use of the control wall 12*c*1 as an example, as a distance between the imaginary center line of the right side wall of the waveguide and a side wall of the conductor post 12*c*1*c* which side wall is the farthest side wall of the post wall 12*c*1 from the right side wall of the waveguide (see FIG. 3).

The slots 11*d*1 through 11*d*6 are each provided at an interface between the first dielectric layer and the atmosphere which have different specific inductive capacities, respectively. This causes reflection of part of an electromagnetic wave propagating through the waveguide inside the first dielectric layer 12. Meanwhile, the slotted waveguide array antenna 1A includes a control wall group consisting of the control walls 12*c*1 through 12*c*6. This makes a magnetic field distribution in a vicinity of one (e.g., slot 11*d*1) of two adjacent slots similar in shape to a magnetic field distribution in the vicinity of the other one (e.g., slot 11*d*2) of the two adjacent slots (see (a) of FIG. 7). Consequently, the slotted waveguide array antenna 1A can make an amplitude of a reflected wave caused by the one slot equal (or close) to an amplitude of a reflected wave caused by the other slot. The magnetic field distributions in the slotted waveguide array antenna 1A will be described later with reference to FIG. 6 in Example.

Further, intervals $d_p$, at which the control walls 12*c*1 through 12*c*6 are provided periodically, are adjusted so that a phase difference between the reflected wave caused by the one slot and the reflected wave caused by the other slot is 180°+360°×n (n=0, 1, 2, . . . ). Thus, the slotted waveguide array antenna 1A can cause the reflected waves caused by adjacent slots to cancel each other out.

Furthermore, it is preferable that the width $W_{cw}$ of each of the control walls 12*c*1 through 12*c*6 is not less than half the width W of the waveguide of the slotted waveguide array antenna 1A. With this arrangement, even in a case where the reflected waves caused by the slots 11*d*1 through 11*d*6 each have a large amplitude, the control walls 12*c*1 through 12*c*6 can cause reflected waves whose amplitudes are sufficiently large to cancel out the reflected waves caused by the slots. Therefore, the slotted waveguide array antenna 1A can suppress a reflection coefficient to a sufficiently small level.

The second conductor layer 13 has the opening 13*a*. The waveguide tube 1B is connected to the slotted waveguide array antenna 1A so that a waveguide 1Ba inside the waveguide tube 1B communicates with the waveguide of the slotted waveguide array antenna 1A via the opening 13*a*.

The waveguide tube 1B is a feeding section for feeding an electromagnetic wave to the slotted waveguide array antenna 1A. The waveguide tube 1B is a tubular member both ends of which are open. The waveguide tube 1B has a tube wall made of a conductor such as a metal. A cavity inside the waveguide tube 1B can be filled with air or alternatively with a dielectric material other than the air. In First Embodiment, the former arrangement is employed. The cavity serves as the waveguide 1Ba which guides an electromagnetic wave.

[Layout of Slots]

With reference to FIG. 3, the following discusses a layout of the slots 11*d*1 through 11*d*6 in the first conductor layer 11. FIG. 3 is a plan view of the slotted waveguide array antenna 1A when viewed from above, and is an enlarged view of vicinities of the control walls 12*c*1 and 12*c*2. Each of the slots 11*d*1 through 11*d*6 is a rectangular opening which has a long side parallel to the side wall of the first dielectric layer 12 and a short side perpendicular to the side wall of the waveguide.

The waveguide of the first dielectric layer 12 is partitioned into seven sub-regions by the control walls 12*c*1 through 12*c*6. These seven sub-regions include (1) a sub-region from the rear side wall to the control wall 12*c*1, (2) a sub-region from the control wall 12*c*1 to the control wall 12*c*2, (3) a sub-region from the control wall 12*c*2 to the control wall 12*c*3, (4) a sub-region from the control wall 12*c*3 to the control wall 12*c*4, (5) a sub-region from the control wall 12*c*4 to the control wall 12*c*5, (6) a sub-region from the control wall 12*c*5 to the control wall 12*c*6, and (7) a sub-region from the control wall 12*c*7 to the front side wall.

When the slotted waveguide array antenna 1A is viewed from above, each of the slots 11*d*1 through 11*d*6 in the first conductor layer 11 is provided so as to extend over an interface between adjacent sub-regions formed by partition with a corresponding one of the control walls 12*c*1 through 12*c*6, and so as not to overlap the corresponding one of the control walls 12*c*1 through 12*c*6 which one control wall separates the adjacent sub-regions with the interface therebetween.

This arrangement is specifically described below with reference to FIG. 3. The slot 11*d*1 is provided so as to extend over an interface between the sub-regions (1) and (2) formed by partition with the control wall 12*c*1, and so as not to overlap the control wall 12*c*1 which separates the adjacent sub-regions (1) and (2) with the interface therebetween. The slot 11*d*2 is provided so as to extend over an interface between the sub-regions (2) and (3) formed by partition with the control wall 12*c*2, and so as not to overlap the control wall 12*c*2 which separates the adjacent sub-regions (2) and (3) with the interface therebetween. The slots 11*d*3 through 11*d*6 are provided in the same manner as the slots 11*d*1 and 11*d*2 and so explanations thereof are omitted.

It is preferable that the intervals $d_p$ which are intervals of the control walls be each substantially equal to $\lambda_g/2$ [mm] where $\lambda_g$ is a guide wavelength at a central frequency $f_0$ [Hz] of an operation band. A frequency at which the reflection coefficient is minimum in the slotted waveguide array antenna 1A also depends strongly on relative positions of the control wall and the slot which constitute a unit structure, as described later in Example. Accordingly, the intervals $d_p$ at which the control walls are provided periodically is variable depending on relative positions of the control wall and the slot which constitute a unit structure, and is not necessarily required to be close to $\lambda_g/2$.

The plurality of control walls can be provided in such a manner as to be aligned along a tube axis of the waveguide on one side of the waveguide (at a position closer to the right side wall or left side wall with respect to the tube axis (center)), instead of the zigzag manner. Each slot is provided at a position opposite to a corresponding one of the control walls (at a position closer to the left side wall or the right side wall relative to the corresponding control wall) so as to extend over an interface between adjacent sub-regions. In this case, the intervals $d_p$ which are intervals of control walls are preferably, but not necessarily, substantially equal to $\lambda_g$ [mm].

"Guide wavelength" in the present specification indicates a wavelength $\lambda_g$ given as follows. Specifically, a TE10 mode electromagnetic wave which is guided in a rectangular parallelepiped waveguide like a waveguide 1A1 is a wave in which two plane waves are synthesized. An angle θ which the two plane waves make with the tube axis is given by $\cos\theta=(1-(fc/f)^2)^{1/2}$ where f represents a frequency and fc represents a cutoff frequency. Further, fc can be expressed by $fc=(c/2W)\times(\varepsilon_r\mu_r)^{-1/2}$ where c represents a light speed, W represents a width of the waveguide, $\varepsilon_r$ represents a specific inductive capacity of a medium of the waveguide, and $\mu_r$ represents a specific permeability. The wavelength λ in the waveguide is expressed by $\lambda=\lambda_0/(\varepsilon_r\mu_r)^{1/2}$ where $\lambda_0$ represents a wavelength in a free space. Here, $\lambda/\cos\theta$ is the guide wavelength λg.

[Conversion Section]

Figure 4:
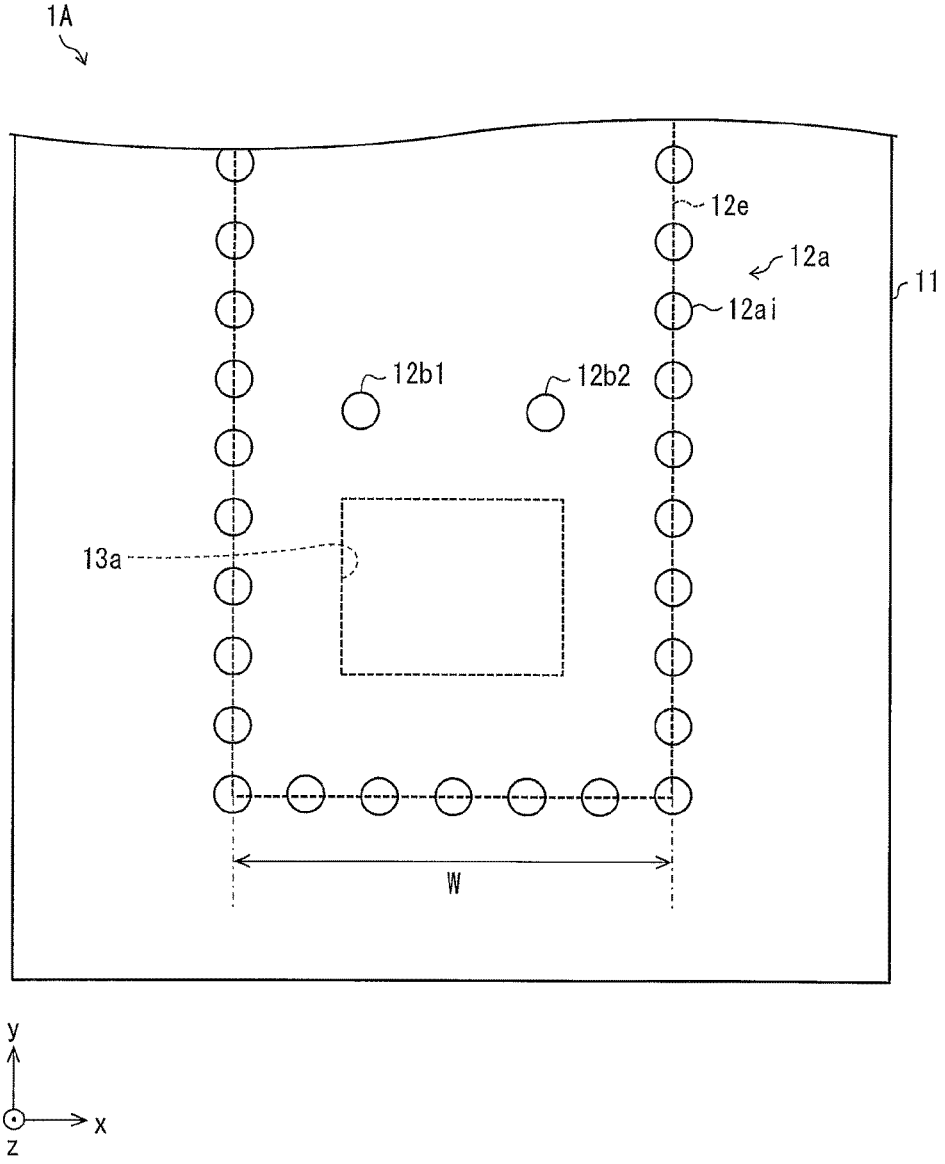
FIG. 4 is a plan view of a part of the slotted waveguide array antenna illustrated in FIG. 1 when viewed from above.

With reference to FIG. 4, the following discusses an arrangement of a conversion section included in the slotted waveguide array antenna 1A. FIG. 4 is a plan view illustrating the slotted waveguide array antenna 1A viewed from above, and is an enlarged view of the vicinity of the conversion section which converts a waveguide mode of an electromagnetic wave.

As illustrated in FIG. 4, it is preferable that control posts 12*b*1 and 12*b*2 be provided in the vicinity of the opening 13*a* in the first dielectric layer 12. More specifically, it is preferable that the control posts 12*b*1 and 12*b*2 be provided between imaginary lines extended in the positive direction of the y-axis from two of four sides of the opening 13*a*, which two sides are parallel to the left side wall and the right side wall of the waveguide inside the first dielectric layer 12, respectively. The control posts 12*b*1 and 12*b*2 are each a cylindrical conductor whose upper end is connected to the first conductor layer 11 and whose lower end is connected to the second conductor layer 13. More specifically, the control posts 12*b*1 and 12*b*2 are each a conductor plating formed on a wall surface of a through hole formed through the first dielectric layer 12.

In First Embodiment, a region spreading on the negative side in the y-axis direction relative to the control posts 12*b*1 and 12*b*2 and having three sides surrounded by the post wall 12*a* and remaining one side surrounded by the control posts 12*b*1 and 12*b*2 is referred to as the conversion section. The conversion section can be alternatively expressed as a feeding section which is supplied with an electromagnetic wave from the waveguide tube 1B.

An electromagnetic wave having propagated in the positive direction of the z-axis in the waveguide 1Ba of the waveguide tube 1B enters the conversion section of the first dielectric layer 12 via the opening 13*a* of the second conductor layer 13. The conversion section of the first dielectric layer 12 converts a waveguide mode of the electromagnetic wave from a waveguide mode of the waveguide 1Ba to a waveguide mode of the waveguide provided in the first dielectric layer 12. In this case, placement of the control posts 12*b*1 and 12*b*2 can suppress reflection of the electromagnetic wave at the conversion section of the first dielectric layer 12. Accordingly, this arrangement can suppress a loss of the electromagnetic wave when the conversion section of the first dielectric layer 12 converts the waveguide mode of the electromagnetic wave. The control posts 12*b*1 and 12*b*2 function as reflection-suppressing posts for suppressing reflection of the electromagnetic wave at the conversion section of the first dielectric layer 12.

A process for producing the control walls 12*c*1 through 12*c*6 included in the slotted waveguide array antenna 1A is the same as a process for producing the post wall 12*a*, and can use a printed circuit board technique. Accordingly, a production cost for the slotted waveguide array antenna 1A is equal to that for a conventional post wall waveguide antenna. Therefore, the slotted waveguide array antenna 1A can obtain a better radiation characteristic and a better gain than a conventional slotted waveguide array antenna while suppressing increase in production cost from a production cost of a conventional slotted waveguide tube array antenna.

Example 1

With reference to FIGS. 5 through 7, the following discusses Example 1 of the slotted array antenna module 1 including the slotted waveguide array antenna 1A in accordance with First Embodiment. As for definitions of dx and dy in the following description, see FIG. 3.

In the slotted waveguide array antenna 1A in accordance with Example 1, sections of the slotted array antenna module 1 illustrated in FIG. 1 were arranged as follows in order that 60 GHz band (frequency band whose central frequency is 60 GHz) might be an operation band.

The first conductor layer 11 was made of a conductor (specifically, copper) plate of 20 μm in thickness.

The first dielectric layer 12 was made of a liquid crystal polymer substrate (whose specific inductive capacity was 3) of 0.6 mm in thickness.

The second conductor layer 13 was made of a conductor (specifically, copper) plate of 20 μm in thickness.

The post wall 12*a* was constituted by the conductor post 12*ai* obtained by (i) forming a through-via of 200 μm in diameter which penetrates the first conductor layer 11, the first dielectric layer 12, and the second conductor layer 13 and then (ii) plating the through-via with a conductor (specifically, copper). A distance between respective central axes of adjacent two conductor posts 12*ai* and 12*aj* was set to 400 μm. The width W of the waveguide constituted by the post wall 12*a* was set to 2.4 mm.

The control walls 12*c*1 through 12*c*6 were each constituted by the conductor posts each obtained by (i) forming a through-via of 200 μm in diameter which penetrates the first conductor layer 11, the first dielectric layer 12, and the second conductor layer 13 and then (ii) plating the through-via with a conductor (specifically, copper). Intervals of respective centers of three conductor posts (e.g., conductor posts 12*c*1*a* through 12*c*1*c*) constituting the control wall were set to 400 μm. The intervals $d_p$ of the control walls 12*c*1 through 12*c*6 were set to approximately 1.8 mm.

The slots 11*d*1 through 11*d*6 were each arranged such that: a slot length (length parallel to the y-axis of the coordinate system in FIG. 3) was set to 1.9 mm, and a slot width (length parallel to the x-axis of the coordinate system)

was set to 250 μm. As illustrated in FIG. 3, a distance between the control wall 12*c*2 and the slot 11*d*2 which extends over an interface of two sub-regions formed by partition with the control wall 12*c*2 was defined as a distance dx. In Embodiment 1, one of two base points used for defining the distance dx is a center C of the conductor post 12*c*2*c* which is the farthest, among the conductor posts constituting the control wall 12*c*2, from the left side wall of the waveguide. The other of the two base points used for defining the distance dx is an intersection D of (i) the interface of the two sub-regions formed by partition with the control wall 12*c*2 and (ii) the slot 11*d*2 extending over the interface.

Furthermore, a distance between (i) the interface of the two sub-regions formed by partition with the control wall 12*c*2 and (ii) one of two short sides of the slot 11*d*2 extending over the interface, which one side is closer to the feeding section supplied with an electromagnetic wave (which one side is on the negative side in the y-axis direction relative to the other side), is defined as a distance dy.

The waveguide tube 1B was a rectangular waveguide tube WR-15 (EIA standard). On a top surface at an end of the waveguide tube 1B, the second conductor layer 13, the first dielectric layer 12, and the first conductor layer 11 were laminated in this order. The waveguide of the first dielectric layer 12 communicates with the waveguide 1Ba of the waveguide tube 1B via the opening 13*a* of the second conductor layer 13.

(a) and (b) of FIG. 5 are each a graph showing reflection characteristics (frequency characteristics of reflection coefficient) of the slotted waveguide array antenna 1A according to Example 1. More specifically, (a) of FIG. 5 is a graph showing reflection characteristics of the slotted waveguide array antennas 1A in a case where the distance $dy/\lambda_g$ was fixed to 0.42 and the distance $dx/\lambda_g$ was set to 0.1, 0.17, 0.21, 0.24, and 0.31. (b) of FIG. 5 is a graph showing reflection characteristics of the slotted waveguide array antennas 1A in a case where the distance $dx/\lambda_g$ was fixed to 0.22 and the distance $dy/\lambda_g$ was set to 0.35, 0.38, 0.42, 0.45, and 0.48.

[Dependency of Reflection Characteristics on Positions of Slots]

With reference to (a) of FIG. 5, it was found that, in a case where the distance $dy/\lambda_g$ was fixed to 0.42 and the distance $dx/\lambda_g$ was varied in a range of 0.1 to 0.31, the minimum value of reflection coefficient shown by each of all the slotted waveguide array antennas 1A was lower than −10 dB which is a generally required level. Hereinafter, a criterion for determining whether a reflection characteristic is good or not is whether the minimum value of reflection coefficient is less than −10 dB. That is, the slotted waveguide array antenna 1A exhibiting a reflection characteristic which meets the criterion is determined as a slotted waveguide array antenna exhibiting a good reflection characteristic. Accordingly, all the slotted waveguide array antennas 1A shown in (a) of FIG. 5 can be considered as slotted waveguide array antennas exhibiting good reflection characteristics. Herein, $dx/\lambda_g$ is a normalized distance dx between a control wall and a slot at a guide wavelength $\lambda_g$ of 70 GHz. Since the wavelength $\lambda_0$ in vacuum at 70 GHz is approximately 4.29 mm, the wavelength λ in a dielectric whose specific inductive capacity is 3 is approximately 2.47 mm and the guide wavelength $\lambda_g$ used for normalization is approximately 2.89 mm.

With reference to (a) of FIG. 5, it was found that in the slotted waveguide array antenna 1A whose distance $dy/\lambda_g$ was fixed to 0.42, the frequency $f_0$ at which the reflection coefficient was minimum is: 67.5 GHz in a case where the distance $dx/\lambda_g$=0.1; 64.0 GHz in a case where the distance $dx/\lambda_g$=0.17; 62.25 GHz in a case where the distance $dx/\lambda_g$=0.21; 58.5 GHz in a case where the distance $dx/\lambda_g$=0.24; and 57.5 GHz in a case where the distance $dx/\lambda_g$=0.31.

This shows that in the slotted waveguide array antenna 1A, as the distance $dx/\lambda_g$ is increased in a range of 0.1 to 0.31, the frequency $f_0$ shifts to a lower frequency. This indicates that changing the distance $dx/\lambda_g$ allows variable control of the frequency $f_0$ within a range of 57.5 GHz to 67.5 GHz while maintaining good reflection characteristics. In other words, changing the distance $dx/\lambda_g$ in the slotted waveguide array antenna 1A makes it possible to realize a slotted waveguide array antenna whose reflection coefficient is minimum at a desired frequency in a range of 57.5 GHz to 67.5 GHz.

With reference to (b) of FIG. 5, it was found that, in a case where the distance $dx/\lambda_g$ was fixed to 0.22 and the distance $dy/\lambda_g$ was varied in a range of 0.35 to 0.48, the minimum value of reflection coefficient shown by each of all the slotted waveguide array antennas 1A was lower than −10 dB which is a generally required level. Accordingly, all the slotted waveguide array antennas 1A shown in (b) of FIG. 5 can be considered as slotted waveguide array antennas exhibiting good reflection characteristics. Herein, $dy/\lambda_g$ is a normalized distance dy between a control wall and a short side of a slot at a guide wavelength $\lambda_g$ of 70 GHz. Since the wavelength $\lambda_0$ in vacuum at 70 GHz is approximately 4.29 mm, the wavelength λ in a dielectric whose specific inductive capacity is 3 is approximately 2.47 mm, and the guide wavelength $\lambda_g$ used for normalization is approximately 2.89 mm.

With reference to (b) of FIG. 5, it was found that in the slotted waveguide array antenna 1A whose distance $dx/\lambda_g$ was fixed to 0.22, the minimum value of reflection coefficient in the frequency band is: −11.3 dB in a case where the distance $dy/\lambda_g$=0.35; −15.9 dB in a case where the distance $dy/\lambda_g$=0.38; −23.4 dB in a case where the distance $dy/\lambda_g$=0.42; −14.1 dB in a case where the distance $dy/\lambda_g$=0.45; and −12.1 dB in a case where the distance $dy/\lambda_g$=0.48.

[Relation Between Frequency $f_0$ and Gain]

(a) of FIG. 6 is a graph showing an azimuth-dependency of a gain [dBi] in the z-x plane of the slotted waveguide array antenna 1A whose distance $dx/\lambda_g$ was set to 0.31 among the slotted waveguide array antennas 1A in Example 1. In the graph, 0° corresponds to the positive direction of the z-axis in the coordinate system in FIG. 1, and −180° corresponds to the negative direction of the z-axis in the coordinate system. In the graph, 90° corresponds to the positive direction of the x-axis in the coordinate axes, and −90° corresponds to the negative direction of the x-axis in the coordinate axes. A solid line in (a) of FIG. 6 indicates an azimuth-dependency of a gain at 67.5 GHz, and a broken line indicates an azimuth-dependency of again at 57.5 GHz. The frequency $f_0$ of the slotted waveguide array antenna 1A whose distance $dx/\lambda_g$ is 0.31 is 57.5 GHz.

In comparison of a case of 57.5 GHz corresponding to the frequency $f_0$ and a case of 67.5 GHz at which the reflection coefficient is larger than that at 57.5 GHz, it was found that a gain is larger in the case of 57.5 GHz.

(b) of FIG. 6 is a graph showing an azimuth-dependency of a gain in the z-x plane of the slotted waveguide array antenna 1A whose distance $dx/\lambda_g$ was 0.1 among the slotted waveguide array antennas 1A in Example 1. How angles in the graph correspond to the coordinate system in FIG. 1 is the same as that in the case of (a) of FIG. 6. A solid line in (b) of FIG. 6 indicates an azimuth-dependency of a gain at 67.5 GHz, and a broken line indicates an azimuth-dependency of a gain at 57.5 GHz. The frequency $f_0$ of the slotted waveguide array antenna 1A whose distance $dx/\lambda_g$ is 0.1 is 67.5 GHz.

In comparison of a case of 67.5 GHz corresponding to the frequency $f_0$ and a case of 57.5 GHz at which the reflection coefficient is larger than that at 67.5 GHz, it was found that a gain is larger in the case of 67.5 GHz.

It was found from the above that a larger gain is obtained at a frequency at which the reflection coefficient is small than at a frequency at which a reflection coefficient is large.

Therefore, it was found in the slotted waveguide array antenna 1A in Example 1, that (i) changing a relative position of the slot (e.g., slot 11*d*1) with respect to the control wall (e.g., control wall 12*c*1) allows variable control of the frequency $f_0$ at which the reflection coefficient is minimum and (ii) a gain obtained at the frequency $f_0$ is larger than a gain obtained at a frequency at which the reflection coefficient is larger. That is, in a case where a frequency of an electromagnetic wave to be radiated with use of the slotted waveguide array antenna 1A is predetermined, changing a relative position of a slot with respect to a control wall as above makes it possible to design the slotted waveguide array antenna 1A in which the electromagnetic wave to be radiated has the frequency $f_0$. In other words, changing a relative position of a slot with respect to a control wall makes it possible to realize the slotted waveguide array antenna 1A whose gain is selectively increased for an electromagnetic wave having a predetermined frequency.

[Magnetic Field Distribution]

(a) of FIG. 7 is a graph showing a magnetic field distribution in a case where an electromagnetic wave of 57.5 GHz corresponding to the frequency $f_0$ entered the slotted waveguide array antenna 1A whose distance $dx/\lambda_g$ was 0.31 among the slotted array antennas 1A in Example 1. (b) of FIG. 7 is a graph showing a magnetic field distribution in a case where an electromagnetic wave of 67.5 GHz, at which a reflection coefficient larger than the frequency $f_0$ is exhibited, entered that slotted waveguide array antenna 1A. The magnetic field distributions illustrated in (a) and (b) of FIG. 7 are H-plane magnetic field distributions of TE mode electromagnetic waves propagating in the waveguide of the first dielectric layer 12.

With reference to (a) of FIG. 7, it was found that respective magnetic field distributions in the vicinities of the slots 11*d*1, 11*d*2, 11*d*3, and 11*d*4 are semicircular with respective centers of the slots as centers of such semicircles. It was also found that the magnetic field distributions are very similar in distribution shape, though different in magnetic field strength. The magnetic field strength differs depending on the positions of the slots 11*d*1 through 11*d*4. This is because an electromagnetic wave fed from a left end of (a) of FIG. 7 weakens in power strength due to radiation from the slots 11*d*1 through 11*d*4 or the like as the electromagnetic wave propagates in the y-axis direction in the coordinate system of (a) of FIG. 7.

Here, regarding the slots 11*d*1 and 11*d*2, the magnetic field distribution in the vicinity of the slot 11*d*1 is similar in shape to the magnetic field distribution in the vicinity of the slot 11*d*2. Accordingly, it can be inferred that a reflected wave caused by the slot 11*d*1 and a reflected wave caused by the slot 11*d*2 have an equal amplitude or similar amplitude values. Furthermore, a path difference between the reflected wave caused by the slot 11*d*1 and the reflected wave caused by the slot 11*d*2 is 180°+360°×n (n=0, 1, 2, . . . ). As a result, it is considered that the reflected wave caused by the slot 11*d*1 and the reflected wave caused by the slot 11*d*2 cancel each other out.

The reflected wave caused by the slot 11*d*2 and a reflected wave caused by the slot 11*d*3 can be considered similarly. It is inferred that the reflected wave caused by the slot 11*d*2 and the reflected wave caused by the slot 11*d*3 have an equal amplitude or similar amplitude values because the magnetic field distribution in the vicinity of the slot 11*d*2 is similar in shape to the magnetic field distribution in the vicinity of the slot 11*d*3. Furthermore, it is considered that a phase difference between the reflected wave caused by the slot 11*d*2 and the reflected wave caused by the slot 11*d*3 is 180°+360°×n (n=0, 1, 2, . . . ). As a result, it is considered that the reflected wave caused by the slot 11*d*2 and the reflected wave caused by the slot 11*d*3 cancel each other out.

As in the above description, the reflected wave caused by the slot 11*d*4, the reflected wave caused by the slot 11*d*5, and the reflected wave caused by the slot 11*d*6 are each canceled out by a wave caused by an adjacent slot.

Therefore, as illustrated in (a) of FIG. 7, it is possible to suppress a reflection coefficient of the slotted waveguide array antenna 1A for an electromagnetic wave having a frequency well matching the positions of the control walls 12*c*1 through 12*c*6 and the slots 11*d*1 through 11*d*6, because a reflected wave caused by each slot is canceled out by a reflected wave caused by an adjacent slot to the slot. Consequently, the frequency $f_0$ of the slotted waveguide array antenna 1A is considered to be a frequency which best matches the positions of the control walls 12*c*1 through 12*c*6 and the slots 11*d* 1 through 11*d*6 of the slotted waveguide array antenna 1A.

With reference to (b) of FIG. 7, it was found that respective magnetic field distributions in the vicinities of the slots 11*d*1, 11*d*2, 11*d*3, and 11*d*4 are not uniform. For example, the magnetic field in the vicinity of the slot 11*d*1 has a large number of components parallel to the y-axis of the coordinate system in (b) of FIG. 7. On the other hand, the magnetic field in the vicinity of the slot 11*d*2 has a large number of components parallel to the x-axis. In this way, the magnetic field distributions have different shapes, respectively. Accordingly, it is considered that the reflected wave caused by the slot 11*d*1 and the reflected wave caused by the slot 11*d*2 have different amplitudes, and therefore cannot cancel each other out.

Similarly, comparison of the vicinity of the slot 11*d*3 and the vicinity of the slot 11*d*4 reveals that respective magnetic field distributions in the vicinities of the slots 11*d*3 and 11*d*4 have different shapes. Accordingly, it is considered that a reflected wave caused by the slot 11*d*3 and a reflected wave caused by the slot 11*d*4 have different amplitudes and therefore cannot cancel each other out.

There are sub-regions having similar shapes of magnetic field distributions. For example, the shapes of the magnetic field distributions are similar in the vicinity of the slot 11*d*1 and the vicinity of the slot 11*d*4. It is considered that a reflected wave caused by the slot 11*d*1 and a reflected wave caused by the slot 11*d*4 cancel each other out because a distance between the slots 11*d* 1 and 11*d*4 is $3d_p$. However, it is considered that larger reflection occurs because reflected waves which do not cancel each other out are concurrently present.

As described above, regarding an electromagnetic wave having a frequency which poorly matches the positions of the control walls 12*c*1 through 12*c*6 and the slots 11*d*1 through 11*d*6 of the slotted waveguide array antenna 1A, a reflection coefficient of the slotted waveguide array antenna 1A is considered to be larger because there exist many reflected waves which do not cancel each other out.

Modified Example 1

With reference to FIG. 8, the following discusses a modified example of the slotted waveguide antenna 1A in accordance with First Embodiment. FIG. 8 is an exploded perspective view of a slotted array antenna module 2 including a slotted waveguide array antenna 2A in accordance with First Modified Example.

[Arrangement of Slotted Waveguide Array Antenna]

The slotted waveguide array antenna 2A included in the slotted array antenna module 2 is differently arranged, in points below, from the slotted waveguide array antenna 1A in accordance with First Embodiment.

Control walls 22*c*1 through 22*c*6 are made of rectangular columnar posts formed in a first dielectric layer 22.

A first conductor layer 21 has an opening 21*a*, and the first conductor layer 21 is connected with a waveguide tube 2B in such a manner that the opening 21*a* communicates with a waveguide 2Ba inside the waveguide tube 2B.

In First Modified Example, the above two differences in arrangement will be discussed. Members of the slotted waveguide array antenna 2A which are not described in First Modified Example each have the same arrangement as a member of the slotted waveguide array antenna 1A in accordance with First Embodiment.

[Control Walls 22*c*1 Through 22*c*6]

As illustrated in FIG. 8, each of the control walls 22*c*1 through 22*c*6 constituting a control wall group is made of a plate wall provided in the first dielectric layer 22. Specifically, each of the control walls 22*c*1 through 22*c*6 is a rectangular columnar conductor whose top end is connected with the first conductor layer 21 and whose bottom end is connected with a second conductor layer 23. More specifically, each of the control walls 22*c*1 through 22*c*6 is a conductor plating formed on a wall surface of a rectangular-columnar through hole which is formed through the first dielectric layer 22.

A cross section of each of the control walls 22*c*1 through 22*c*6 in a plane parallel to the x-y plane is a rectangle whose long-side direction is parallel to the x-axis. Each of the control walls 22*c*1 through 22*c*6 in accordance with Modified Example 1 can have a corner portion having a curved line between a long side and a short side. This is because four corners of through hole may be rounded in a case where a through hole whose cross section is rectangular is formed in the first dielectric layer 22.

[Connection with Waveguide Tube]

In the slotted array antenna module 1 in accordance with First Embodiment, the slotted waveguide array antenna 1A is connected with the waveguide tube 1B in such a manner that the opening 13*a* provided in the second conductor layer 13 communicates with the waveguide 1Ba of the waveguide tube 1B (see FIG. 1). In other words, the waveguide tube 1B is connected on a lower side (negative side in a z-axis direction) of the slotted waveguide array antenna 1A. In the slotted array antenna module 2 in accordance with First Modified Example, the slotted waveguide array antenna 2A is connected with the waveguide tube 2B in such a manner that the opening 21*a* provided in the first conductor layer 21 communicates with the waveguide 2Ba of the waveguide tube 2B. In other words, the waveguide tube 2B is connected on an upper side (positive side in the z-axis direction) of the slotted waveguide array antenna 2A.

As described above, in one embodiment of the slotted array antenna module of the present invention, the waveguide tube can be connected with the first conductor layer in which the slots for the slotted waveguide array antenna are provided (First Embodiment), or may alternatively be connected with the second conductor layer which faces the first conductor layer via the first dielectric layer (First Modified Example).

Second Embodiment

With reference to FIGS. 9 and 10, the following discusses a slotted waveguide array antenna in accordance with Second Embodiment of the present invention. FIG. 9 is an exploded perspective view of a slotted array antenna module 3 including a slotted waveguide array antenna 3A in accordance with Second Embodiment. (a) of FIG. 10 is a cross sectional view of the slotted array antenna module 3. (b) of FIG. 10 is a cross sectional view of another aspect of the slotted array antenna module 3 in which a structure of a feeding pin in the slotted array antenna module 3 is changed. (a) and (b) of FIG. 10 show cross sections of the slotted array antenna module 3 which are parallel to a y-z plane and which are taken across feeding pins 32*a* and 34*a* and a conductor post 12*ai*.

[Arrangement of Slotted Array Antenna Module]

The slotted array antenna module 3 in accordance with Second Embodiment is different from the slotted array antenna module 1 in accordance with First Embodiment, in arrangement of a portion which feeds an electromagnetic wave to the slotted waveguide array antenna. In the slotted array antenna module 1, the waveguide tube 1B for feeding an electromagnetic wave is connected with the second conductor layer 13, whereas in the slotted waveguide array antenna 3A, a microstrip line 3B for feeding an electromagnetic wave is provided. Furthermore, the first dielectric layer 32 includes a feeding pin 32*a* with which the electromagnetic wave supplied is radiated into the first dielectric layer 32. In Second Embodiment, the following will mainly discuss the microstrip line 3B and the feeding pin 32*a*.

The slotted array antenna module 3 has a structure in which a first conductor layer 31, the first dielectric layer 32, a second conductor layer 33, a second dielectric layer 34, a third conductor layer 35, and an RFIC 36 are laminated in this order.

The first conductor layer 31, the second conductor layer 33, and the third conductor layer 35 each can be made of, for example, a metal such as copper. Examples of a material for the first dielectric layer 32 include glasses such as quartz glass, fluorine-based resins such as PTFE, liquid crystal polymers, and cycloolefin polymers. Examples of a material for the second dielectric layer 34 include fluorine-based resins such as PTFE, liquid crystal polymers, cycloolefin polymers, and polyimide resins.

In the slotted array antenna module 3, the first conductor layer 31 and the second conductor layer 33, which face each other via the first dielectric layer 32, constitute the slotted waveguide array antenna 3A.

In the first dielectric layer 32, inside a region (waveguide) surrounded by a post wall 12*a* constituted by conductor posts 12*ai*, there is formed a feeding pin 32*a* having a TE mode excitation structure. The feeding pin 32*a* is a hole, which is formed in a direction from an upper surface to a lower surface of the first dielectric layer 32 and has a wall plated with a conductor. The second conductor layer 33 has an opening 33*a* formed for the purpose of avoiding a contact between a lower end of the feeding pin 32*a* and the second conductor layer 33. Consequently, the feeding pin 32*a* is insulated from the second conductor layer 33. Furthermore, although the feeding pin 32*a* is formed in the direction from the upper surface to the lower surface of the first dielectric layer 32, the feeding pin 32*a* is not a through hole. Accordingly, the first dielectric layer 32 exists between the feeding pin 32*a* and the first conductor layer 31. That is, the feeding pin 32*a* is also insulated from the first conductor layer 31. Additionally, the feeding pin 32*a* having the TE mode excitation structure can be also called a feeding section which feeds an electromagnetic wave.

A region whose six sides are surrounded by the first conductor layer 31, the second conductor layer 33, and the post wall 12*a* constituted by the conductor posts 12*ai* serves as a waveguide for guiding an electromagnetic wave.

In the slotted array antenna module 3, a high frequency signal outputted from the RFIC 36 is transmitted as a TEM mode electromagnetic wave through the microstrip line 3B which will be described later. Then, the high frequency signal is converted by the feeding pin 32*a* into a TE mode electromagnetic wave. This electromagnetic wave is guided by the waveguide of the first dielectric layer 32, and is then radiated from the waveguide to the outside of the slotted waveguide array antenna 3A via slots in the first conductor layer 11.

Furthermore, in the slotted array antenna module 3, the second conductor layer 33 and the third conductor layer 35, which face each other via the second dielectric layer 34, constitute the microstrip line 3B (the second conductor layer 33 is shared by the slotted waveguide array antenna 3A and the microstrip line 3B).

The third conductor layer 35 is a conductor pattern printed on a surface of the second dielectric layer 34, and includes a signal line 35*a*, a signal pad 35*b*, and a ground pad 35*c*. The signal line 35*a* is a linear conductor whose one end is connected with a lower end of the feeding pin 34*a* provided in the second dielectric layer 34. The feeding pin 34*a* is a through hole, which penetrates the second dielectric layer 34 from an upper surface to a lower surface of the second dielectric layer 34 and has a wall plated with a conductor. This feeding pin 34*a* has a lower end in contact with an upper end of the feeding pin 32*a* provided in the first dielectric layer 32. Accordingly, the signal line 35*a* is electrically connected to the feeding pin 32*a* via the feeding pin 34*a*. The signal pad 35*b* is a square-shaped planer conductor whose side is connected with the other end of the signal line 35*a*. The ground pad 35*c* is a square-shaped planner conductor which is provided in the vicinity of the signal pad 35*b* but apart from the signal pad 35*b*. The second dielectric layer 34 has a ground via 34*b* which is a through hole, which penetrates the second dielectric layer 34 from an upper surface to a lower surface of the second dielectric layer 34 and has a wall plated with a conductor. A lower end of the ground via 34*b* contacts the ground pad 35*c* and an upper end of the ground via 34*b* contacts the second conductor layer 33. The ground via 34*b* allows the second conductor layer 33 and the first conductor layer 31 short-circuited with the second conductor layer 33 to have a potential equal to a potential (ground potential) of the ground pad 35*c*.

The signal pad 35*b* is bump-connected, via a solder bump 37*a*, with a signal terminal 36*a* formed on the RFIC 36. The ground pad 35*c* is bump-connected, via a solder bump 37*b*, with a ground terminal 36*b* formed on the RFIC 36. These make it possible to feed a high frequency signal generated in the RFIC 36 to the slotted waveguide array antenna 3A without causing reflection of a signal due to parasitic inductance.

What is noteworthy about the slotted array antenna module 3 is that the RFIC 36 is provided so as to overlap the waveguide formed in the first dielectric layer 32 when viewed in a laminating direction (viewed from a negative side in a z-axis direction in FIG. 9). Consequently, an area of the slotted array antenna module 3 viewed in the laminating direction, i.e., an area required for mounting the slotted array antenna module 3 is smaller than the sum of (i) an area of the RFIC 36 viewed in the laminating direction and (ii) an area of the waveguide formed in the first dielectric layer 32 viewed in the laminating direction. That is, the area required for mounting the slotted array antenna module 3 in accordance with Second Embodiment can be substantially the same as an area required for mounting only the slotted waveguide array antenna 3A, although the slotted array antenna module 3 includes the RFIC 36 which outputs a high frequency signal.

There is no concern that antenna characteristics of the slotted array antenna module 3 may change due to capacitive coupling between the slotted array antenna module 3 and the RFIC 36. This is because the second conductor layer 33 is provided between the RFIC 36 and the first conductor layer 31 in which the slots 11*d*1 through 11*d*6 are formed. Furthermore, in the slotted array antenna module 3, electromagnetic waves propagating in a positive direction of the z-axis are radiated from the slots 11*d*1 through 11*d*6. In this arrangement, there is neither a concern that these electromagnetic waves may be disturbed by the RFIC 36 nor a concern that these magnetic waves may interfere with the function of the RFIC 36. This is because though these electromagnetic waves propagate through a space above the slotted waveguide array antenna 3A (on the positive side in the z-axis direction in FIG. 9), the RFIC 36 is provided in a space below the slotted waveguide array antenna 3A (on the negative side in the z-axis direction in FIG. 9). Therefore, the slotted waveguide array antenna 3A can be designed regardless of the presence of the RFIC 36. Furthermore, antenna characteristics of the slotted waveguide array antenna 3A are not influenced by the RFIC 36.

In order to realize such disposition of the RFIC 36 as above, the slotted array antenna module 3 is arranged such that the signal line 35*a* is drawn from the lower end of the feeding pin 34*a* toward a center of the waveguide formed in the first dielectric layer 32 (in a positive direction of a y-axis in FIG. 9).

[Cross Sectional Structure of the Slotted Array Antenna Module]

With reference to FIG. 10, the following discusses the feeding pins 32*a* and 34*a* included in the slotted array antenna module 3 illustrated in FIG. 9. FIG. 10 is a cross sectional view of the slotted array antenna module 3. FIG. 10 illustrates cross sections which are each parallel to the y-z plane (see FIG. 1) of the slotted array antenna module 3 and which are taken across the feeding pins 32*a* and 34*a* and a conductor post 12*ai*.

As illustrated in (a) of FIG. 10, the slotted array antenna module 3 includes the feeding pin 34*a* which is a through hole penetrating the second dielectric layer 34 from a lower surface to an upper surface of the second dielectric layer 34, and the feeding pin 32*a* which extends from a lower surface of the first dielectric layer 32 to the inside of the first dielectric layer 32. The feeding pin 32*a* and the feeding pin 34*a* are formed by (i) plating, with a conductor, walls of (a) a non-through hole formed in the first dielectric layer 32 and (b) a through hole formed in the second dielectric layer 34 and then (ii) stacking the non-through hole and the through hole.

What is noteworthy about the feeding pins 32*a* and 34*a* illustrated in FIG. 10 is that (1) the lower end of the feeding pin 34*a* contacts the signal line 35*a*, (2) a lower end of the feeding pin 32*a* is separated from the second conductor layer 33 by the opening 33*a*, and (3) an upper end of the feeding pin 32*a* is provided inside the first dielectric layer 32 and apart from the first conductor layer 31. This allows the feeding pin 32*a* to be electrically connected with the signal line 35*a* and to be insulated from both of the first conductor layer 31 and the second conductor layer 33.

In Second Embodiment, as illustrated in (a) of FIG. 10, the feeding pin 32*a* is arranged to be a non-through hole which extends from the lower surface of the first dielectric layer 32 to the inside of the first dielectric layer 32 (but does not reach the upper surface of the first dielectric layer 32). However, the present invention is not limited to this arrangement. As illustrated in (b) of FIG. 10, the feeding pin 32*a* can be arranged to be a through hole which penetrates the first dielectric layer 32 from the lower surface to the upper surface of the first dielectric layer 32.

What is noteworthy about the feeding pins 32*a* and 34*a* illustrated in (b) of FIG. 10 is that (1) the lower end of the feeding pin 34*a* contacts the signal line 35*a*, (2) the lower end of the feeding pin 32*a* is separated from the second conductor layer 33 by the opening 33*a*, and (3) the upper end of the feeding pin 32*a* is separated from the first conductor layer 31 by an opening 31*a*. This allows the feeding pin 32*a* to communicate with the signal line 35*a* and to be insulated from both of the first conductor layer 31 and the second conductor layer 33.

In a case where the non-through hole illustrated in (a) of FIG. 10 is used as the feeding pin 32*a*, there is a merit that it is possible to avoid leakage of an electromagnetic wave from the opening 31*a* as compared to a case where the through hole illustrated in (b) of FIG. 10 is used. On the other hand, in the case where the through hole illustrated in (b) of FIG. 10 is used as the feeding pin 32*a*, there is a merit that it is easier to form the feeding pin 32*a* as compared to the case where the non-through hole illustrated in (a) of FIG. 10 is used.

In the case where the through hole illustrated in (b) of FIG. 10 is used as the feeding pin 32*a*, an electromagnetic wave may leak from the opening 31*a*. However, since the RFIC 36 is separated by the two conductor layers 31 and 33 from a space where the electromagnetic wave propagates, there is no concern that the electromagnetic wave may interfere with the function of the RFIC 36.

Modified Example 2

With reference to FIG. 11, the following discusses a modified example of the slotted array antenna module 3 including the slotted waveguide array antenna 3A in accordance with Second Embodiment. FIG. 11 is an exploded perspective view of a slotted array antenna module 4 including a slotted waveguide array antenna 4A in accordance with Second Modified Example.

The slotted array antenna module 4 in accordance with Second Modified Example is different from the slotted array antenna module 3 illustrated in FIG. 9 in that the slotted array antenna module 4 includes an RFIC 46 and a microstrip line 4B above a first conductor layer 41.

The slotted array antenna module 4 has a structure in which the RFIC 46, a third conductor layer 45, a second dielectric layer 44, the first conductor layer 41, a first dielectric layer 42, and a second conductor layer 43 are laminated in this order.

In the slotted array antenna module 4, the first conductor layer 41 and the second conductor layer 43, which face each other via the first dielectric layer 42, constitute the slotted waveguide array antenna 4A. Furthermore, the first conductor layer 41 and the third conductor layer 45, which face each other via the second dielectric layer 44, constitute the microstrip line 4B (the first conductor layer 41 is shared by the slotted waveguide array antenna 4A and the microstrip line 4B).

The third conductor layer 45 is a conductor pattern printed on a surface of the second dielectric layer 44, and includes a signal line 45*a*, a signal pad 45*b*, and a ground pad 45*c*. The signal line 45*a* is a linear conductor whose one end is connected with an upper end of the feeding pin 44*a* provided in the second dielectric layer 44. The feeding pin 44*a* is a through hole, which penetrates the second dielectric layer 44 from a lower surface to an upper surface of the second dielectric layer 44 and has a wall plated with a conductor. This feeding pin 44*a* has a lower end in contact with an upper end of the feeding pin 42*a* provided in the first dielectric layer 32. Accordingly, the signal line 45*a* is electrically connected to the feeding pin 42*a* via the feeding pin 44*a*. The first conductor layer 41 includes an opening 41*a* by which the first conductor layer 41 is separated from the upper end of the feeding pin 42*a*.

What is noteworthy about the feeding pins 42*a* and 44*a* is that (1) the upper end of the feeding pin 44*a* contacts the signal line 45*a*, (2) the upper end of the feeding pin 42*a* is separated from the first conductor layer 41 by the opening 41*a*, and (3) the lower end of the feeding pin 42*a* is inside the first dielectric layer 42 and separated from the second conductor layer 43. This allows the feeding pin 42*a* to be electrically connected with the signal line 45*a* and to be insulated from both of the first conductor layer 41 and the second conductor layer 43.

The signal pad 45*b* is bump-connected, via a solder bump 47*a*, with a signal terminal (not illustrated) formed on the RFIC 46. The ground pad 45*c* is bump-connected, via a solder bump 47*b*, with a ground terminal (not illustrated) formed on the RFIC 46. This makes it possible to supply a high frequency signal generated in the RFIC 46 to the slotted waveguide array antenna 4A without causing reflection of a signal due to parasitic inductance.

As in the case of the slotted array antenna module 3 illustrated in FIG. 9, in the slotted array antenna module 4, there is no concern that antenna characteristics of the slotted array antenna module 4 may change due to capacitive coupling between the slotted array antenna module 4 and the RFIC 36. Furthermore, as in the case of the slotted array antenna module 3 illustrated in FIG. 9, in the slotted array antenna module 4, (1) electromagnetic waves radiated by the slotted array antenna module 4 are not disturbed by the RFIC 46, and (2) these electromagnetic waves do not interfere with the function of the RFIC 46.

In order to realize such disposition of the RFIC 46 as above, the slotted array antenna module 4 is arranged such that the signal line 45*a* is drawn from the upper end of the feeding pin 44*a* in a direction away from a center of the waveguide formed in the first dielectric layer 32 (in a negative direction of a y-axis in FIG. 11).

Conclusion

A slotted waveguide array antenna in accordance with one aspect of the present invention is a slotted waveguide array antenna, including:

a waveguide having a rectangular parallelepiped shape, the waveguide including: an upper wall provided with slots; and control walls provided, inside the waveguide, so as to be orthogonal to the upper wall and side walls of the waveguide, the slots each extending over an interface between regions formed by partition with corresponding one of the control walls but not overlapping the corresponding one of the control walls when viewed from above.

The slotted waveguide array antenna employs an arrangement in which each of the slots extends over an interface between regions formed by partition with a corresponding one of the control walls, and the each slot does not overlap the corresponding one of the control walls when viewed from above. This makes it possible to realize a slotted waveguide array antenna having a smaller reflection coefficient and a larger gain than a conventional slotted waveguide array antenna.

The slotted waveguide array antenna can be arranged such that the control walls are provided in a zigzag manner inside the waveguide.

The slotted waveguide array antenna of the present invention is preferably arranged such that in a direction orthogonal to the side walls of the waveguide, the control walls each have a width equal to or larger than half a width of the waveguide.

With the arrangement, each of the control walls generates a reflected wave having an amplitude sufficient to cancel out a reflected wave caused by a corresponding one of the slots. Therefore, even in a case where the reflected wave caused by the slot have a large amplitude, e.g., even in a case where the inside of the waveguide is filled with a dielectric body whose specific inductive capacity is larger than 1, each of the control walls can cancel out a reflected wave caused by a corresponding one of the slots.

The slotted waveguide array antenna of the present invention is preferably arranged such that in a case where an operation band is in a range of 55 GHz to 70 GHz, a distance dx [m] between one of the control walls and a slot extending over an interface between two regions formed by partition with the one control wall meets a relation $0.10 \leq dx/\lambda_g \leq 0.31$, where $\lambda_g$ is a guide wavelength of the slotted waveguide array antenna at 70 GHz which is an upper limit of the range of the operation band.

With the arrangement, it is possible to realize a slotted waveguide array antenna whose reflection coefficient in the operation band is less than −10 dB.

The slotted waveguide array antenna is preferably arranged such that: (i) each of the slots is a rectangular opening whose long side is parallel to the side walls of the waveguide and whose short side is perpendicular to the side walls of the waveguide; and (ii) for example, in a case where an operation band is in a range of 55 GHz to 70 GHz, a distance dy[m] between (a) an interface between two regions formed by partition with one of the control walls and (b) one of two short sides of a slot extending over the interface which short side is closer to a feeding section meets a relation of $0.35 \leq dy/\lambda_g \leq 0.48$, where $\lambda_g$ is a guide wavelength of the slotted waveguide array antenna at 70 GHz which is an upper limit of the range of the operation band.

With the arrangement, it is possible to realize a slotted waveguide array antenna whose reflection coefficient in the operation band is less than −10 dB.

The slotted waveguide array antenna is preferably arranged such that the waveguide is provided with: a first dielectric layer; a first conductor layer serving as the upper wall of the waveguide; and a second conductor layer serving as a lower wall of the waveguide, the first conductor layer and the second conductor facing each other via the first dielectric layer, and the side walls and the control walls are each a post wall formed by disposition of cylindrical posts in a form of a fence in the first dielectric layer.

The slotted waveguide array antenna having the above arrangement can be produced with use of a printed circuit board technique. In other words, it is unnecessary to bond a base and a slot plate which have been prepared separately by metal processing etc. as in the case of the slotted waveguide tube array antenna disclosed in Patent Literature 1. Therefore, this can suppress production cost to a low cost. Furthermore, there is no concern about a problem of deterioration in transmission quality due to insufficient adhesion between the base and the slot plate.

The slotted waveguide array antenna can be arranged such that the waveguide is provided with: a first dielectric layer; a first conductor layer serving as the upper wall of the waveguide; and a second conductor layer serving as a lower wall of the waveguide, the first conductor layer and the second conductor facing each other via the first dielectric layer, the side walls are each a post wall formed by disposition of cylindrical posts in a form of a fence in the first dielectric layer; and the control walls are each a rectangular columnar plate wall provided in the first dielectric layer.

The slotted waveguide array antenna having the above arrangement can be produced with use of a printed circuit board technique. In other words, it is unnecessary to bond a base and a slot plate which have been prepared separately by metal processing etc. as in the case of the slotted waveguide tube array antenna disclosed in Patent Literature 1. Therefore, this can suppress production cost to a low cost. Furthermore, there is no concern about a problem of deterioration in transmission quality due to insufficient adhesion between the base and the slot plate.

A slotted array antenna module in accordance with one aspect of the present invention includes: the aforementioned slotted waveguide array antenna; a second dielectric layer laminated above the upper wall of the waveguide or below the lower wall of the waveguide; and a third conductor layer which faces the upper wall of the waveguide or the lower wall of the waveguide via the second dielectric layer, the third conductor layer constituting a microstrip line.

With the arrangement, it is possible to feed an electromagnetic wave to the slotted waveguide array antenna with use of a microstrip line which is laminated in a single laminate substrate.

The slotted array antenna module can be arranged such that the slotted waveguide array antenna includes, as a TE mode excitation structure, a through hole which penetrates the first dielectric layer and the second dielectric layer, the through hole having a wall plated with a conductor and being insulated from the upper wall and the lower wall of the waveguide by openings provided in the upper wall and the lower wall of the waveguide, and the through hole also being electrically connected with the third conductor layer.

The slotted array antenna module having the above arrangement can be produced easily, as compared with a slotted array antenna module having a TE mode excitation structure which is a non-through hole.

The slotted array antenna module can be arranged such that the slotted waveguide array antenna includes, as a TE mode excitation structure, a non-through hole which penetrates the second dielectric layer and extends up to a position inside the first dielectric layer from a surface of the first dielectric layer which surface faces the second dielectric layer, the non-through hole being insulated from the upper wall or the lower wall of the waveguide by an opening provided in the first conductor layer or the second conductor layer between the first dielectric layer and the second dielectric layer, and the non-through hole being electrically connected with the third conductor layer.

The slotted array antenna module having the above arrangement can suppress leakage of an electromagnetic wave from the opening as compared with a slotted array antenna module having a TE mode excitation structure which is a through hole.

The slotted array antenna module is preferably arranged to further include an RFIC (Radio Frequency Integrated Circuit) connected with the third conductor layer, the second dielectric layer being laminated below the lower wall of the waveguide, the third conductor layer facing the lower wall of the waveguide via the second dielectric layer, and the RFIC being provided so as to overlap the waveguide when viewed from above.

An area required for mounting the slotted array antenna module is smaller than the sum of (i) an area required for mounting the RFIC and (ii) an area of the waveguide projected onto the lower wall of the waveguide which wall provides a surface on which the RFIC is mounted. That is, with the above arrangement, the area required for mounting the slotted array antenna module can be suppressed to substantially the same area as an area required for mounting only the slotted waveguide array antenna, although the slotted array antenna module includes the RFIC which outputs a high frequency signal.

A slotted array antenna module in accordance with one aspect of the present invention is preferably the slotted array antenna module, including: the aforementioned slotted waveguide array antenna; and a waveguide tube, the waveguide of the slotted waveguide array antenna having one end provided with an opening, and the waveguide tube being connected with the slotted waveguide array antenna so that a waveguide of the waveguide tube communicates with the waveguide of the slotted waveguide array antenna via the opening.

With the arrangement, it is possible to feed an electromagnetic wave to the slotted waveguide array antenna with use of the waveguide tube.

The slotted array antenna module is preferably arranged such that the waveguide is further provided therein with control posts in a vicinity of the opening, and a distance between a left side wall and a right side wall of the waveguide is larger in a region of the waveguide which region includes the opening than in another region of the waveguide which region is other than the region including the opening.

With the arrangement, a loss due to reflection can be suppressed when a waveguide mode of an electromagnetic wave is converted from a waveguide mode of the waveguide in the waveguide tube to a waveguide mode of the waveguide. This makes it possible to obtain a smaller reflection coefficient and a larger gain.

[Additional Matter]

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

The present invention can be suitably used as a slotted waveguide array antenna and a slotted array antenna module including the slotted waveguide array antenna.

REFERENCE SIGNS LIST

1 Slotted array antenna module
1A Slotted waveguide array antenna
11 First conductor layer
11*d*1-11*d*6 Slot
12 First dielectric layer
12*a* Post wall
12*ai* Conductor post
12*b*1-12*b*2 Control post
12*c*1-12*c*6 Control wall
13 Second conductor layer
13*a* Opening
1B Waveguide tube
1Ba Waveguide

The invention claimed is:

1. A slotted waveguide array antenna comprising a waveguide having a rectangular parallelepiped shape,
- the waveguide including:
  - an upper wall provided with slots; and
  - control walls provided, inside the waveguide, so as to be orthogonal to the upper wall and side walls of the waveguide,
- the slots each extending over an interface between regions formed by partition with a corresponding one of the control walls but not overlapping the corresponding one of the control walls, when viewed from above,
- wherein the control walls are provided in a zigzag manner inside the waveguide,
- wherein in a direction orthogonal to the side walls of the waveguide, the control walls each have a width equal to or larger than half a width of the waveguide.

2. The slotted waveguide array antenna as set forth in claim 1, wherein:
- the waveguide is provided with:
  - a first dielectric layer;
  - a first conductor layer serving as the upper wall of the waveguide; and
  - a second conductor layer serving as a lower wall of the waveguide, the first conductor layer and the second conductor facing each other via the first dielectric layer; and
- the side walls and the control walls are each a post wall formed by disposition of cylindrical posts in a form of a fence in the first dielectric layer.

3. The slotted waveguide array antenna as set forth in claim 1, wherein:
- the waveguide is provided with:
  - a first dielectric layer;
  - a first conductor layer serving as the upper wall of the waveguide; and
  - a second conductor layer serving as a lower wall of the waveguide, the first conductor layer and the second conductor facing each other via the first dielectric layer;
- the side walls are each a post wall formed by disposition of cylindrical posts in a form of a fence in the first dielectric layer; and
- the control walls are each a rectangular columnar plate wall provided in the first dielectric layer.

4. A slotted array antenna module comprising:

the slotted waveguide array antenna as set forth in claim 2;

a second dielectric layer laminated above the upper wall of the waveguide or below the lower wall of the waveguide; and a third conductor layer which faces the upper wall of the waveguide or the lower wall of the waveguide via the second dielectric layer, the third conductor layer constituting a microstrip line.

5. The slotted array antenna module as set forth in claim 4, wherein the slotted waveguide array antenna includes, as a TE mode excitation structure, a through hole which penetrates the first dielectric layer and the second dielectric layer, the through hole having a wall plated with a conductor and being insulated from the upper wall and the lower wall of the waveguide by openings provided in the upper wall and the lower wall of the waveguide, and the through hole also being electrically connected with the third conductor layer.

6. The slotted array antenna module as set forth in claim 4, wherein the slotted waveguide array antenna includes, as a TE mode excitation structure, a non-through hole which penetrates the second dielectric layer and extends up to a position inside the first dielectric layer from a surface of the first dielectric layer which surface faces the second dielectric layer, the non-through hole being insulated from the upper wall or the lower wall of the waveguide by an opening provided in the first conductor layer or the second conductor layer between the first dielectric layer and the second dielectric layer, and the non-through hole being electrically connected with the third conductor layer.

7. The slotted array antenna module as set forth in claim 4, further comprising an RFIC (Radio Frequency Integrated Circuit) connected with the third conductor layer, the second dielectric layer being laminated below the lower wall of the waveguide, the third conductor layer facing the lower wall of the waveguide via the second dielectric layer, and the RFIC being provided so as to overlap the waveguide when viewed from above.

8. A slotted array antenna module comprising:

the slotted waveguide array antenna as set forth in claim 3;

a second dielectric layer laminated above the upper wall of the waveguide or below the lower wall of the waveguide; and a third conductor layer which faces the upper wall of the waveguide or the lower wall of the waveguide via the second dielectric layer, the third conductor layer constituting a microstrip line.

9. The slotted array antenna module as set forth in claim 8, wherein the slotted waveguide array antenna includes, as a TE mode excitation structure, a through hole which penetrates the first dielectric layer and the second dielectric layer, the through hole having a wall plated with a conductor and being insulated from the upper wall and the lower wall of the waveguide by openings provided in the upper wall and the lower wall of the waveguide, and the through hole also being electrically connected with the third conductor layer.

10. The slotted array antenna module as set forth in claim 8, wherein the slotted waveguide array antenna includes, as a TE mode excitation structure, a non-through hole which penetrates the second dielectric layer and extends up to a position inside the first dielectric layer from a surface of the first dielectric layer which surface faces the second dielectric layer, the non-through hole being insulated from the upper wall or the lower wall of the waveguide by an opening provided in the first conductor layer or the second conductor layer between the first dielectric layer and the second dielectric layer, and the non-through hole being electrically connected with the third conductor layer.

11. The slotted array antenna module as set forth in claim 8, further comprising an RFIC (Radio Frequency Integrated Circuit) connected with the third conductor layer, the second dielectric layer being laminated below the lower wall of the waveguide, the third conductor layer facing the lower wall of the waveguide via the second dielectric layer, and the RFIC being provided so as to overlap the waveguide when viewed from above.

12. A slotted array antenna module comprising:

the slotted waveguide array antenna as set forth in claim 1; and a waveguide tube, the waveguide of the slotted waveguide array antenna having one end provided with an opening, and the waveguide tube being connected with the slotted waveguide array antenna so that a waveguide of the waveguide tube communicates with the waveguide of the slotted waveguide array antenna via the opening.

* * * * *